US009109354B2

(12) United States Patent
Toubia et al.

(10) Patent No.: US 9,109,354 B2
(45) Date of Patent: Aug. 18, 2015

(54) RAPID ASSEMBLY OF A MODULAR STRUCTURE

(71) Applicant: University of Dayton, Dayton, OH (US)

(72) Inventors: Elias Toubia, Dayton, OH (US); Danny Tilton, Burnside, KY (US)

(73) Assignee: University of Dayton, Dayton, OH (US)

( * ) Notice: Subject to any disclaimer, the term of this patent is extended or adjusted under 35 U.S.C. 154(b) by 0 days.

(21) Appl. No.: 13/943,964

(22) Filed: Jul. 17, 2013

(65) Prior Publication Data

US 2015/0020463 A1 Jan. 22, 2015

(51) Int. Cl.

| | |
|---|---|
| ***E04D 13/04*** | (2006.01) |
| ***E04B 1/343*** | (2006.01) |
| ***E04H 1/00*** | (2006.01) |

(52) U.S. Cl.

CPC ..... *E04B 1/34321* (2013.01); *E04B 1/34315* (2013.01); *E04D 13/04* (2013.01); *E04H 1/005* (2013.01)

(58) Field of Classification Search

CPC ..... E04B 1/34321; E04B 1/34384; E04B 1/34315; E04B 1/3444; E04H 1/005; E04D 13/04; E04D 1/3455; E04D 1/3461

USPC ..... 52/79.9, 79.5, 79.7, 79.8, 127.2, 741.4, 52/745.15, 745.05, 23, 205, 409, 546, 578, 52/582.1, 585.1, 518–522

See application file for complete search history.

(56) References Cited

U.S. PATENT DOCUMENTS

| | | | | | |
|---|---|---|---|---|---|
| 1,968,452 | A | * | 7/1934 | Hering | 52/466 |
| 2,003,503 | A | * | 6/1935 | Eason | 52/545 |
| 2,070,648 | A | * | 2/1937 | Calkins et al. | 52/92.2 |
| 2,254,044 | A | * | 8/1941 | Lytle | 52/547 |
| 2,256,104 | A | * | 9/1941 | Ringle | 52/394 |
| 2,564,691 | A | * | 8/1951 | Heiles | 52/641 |
| 2,780,844 | A | * | 2/1957 | Bolt | 52/69 |
| 3,017,800 | A | * | 1/1962 | Cohen | 411/34 |
| 3,083,506 | A | * | 4/1963 | Cascossa | 52/409 |
| 3,427,775 | A | * | 2/1969 | Bachrich | 52/402 |
| 3,567,260 | A | * | 3/1971 | Norris | 52/127.11 |
| 3,783,570 | A | * | 1/1974 | Storch | 52/520 |
| 3,851,428 | A | * | 12/1974 | Shuart | 52/285.2 |
| 3,858,364 | A | * | 1/1975 | Proulx | 52/127.1 |
| 4,231,199 | A | * | 11/1980 | Gomez et al. | 52/91.2 |
| 4,534,141 | A | * | 8/1985 | Fagnoni | 52/68 |
| 4,726,158 | A | * | 2/1988 | Fagnoni | 52/79.5 |
| 5,287,670 | A | * | 2/1994 | Funaki | 52/544 |
| 5,345,740 | A | * | 9/1994 | Huang | 52/551 |

(Continued)

FOREIGN PATENT DOCUMENTS

WO WO-2014/020579 A1 * 2/2014 ..... E04D 1/34

*Primary Examiner* — Brent W Herring

(74) *Attorney, Agent, or Firm* — Wood, Herron & Evans, LLP

(57) ABSTRACT

A modular structure formed by panels is disclosed, having a center compartment and first and second side compartments coupled to the opposing sides of the center compartment. Each panel of the modular structure is joined to each respective adjacent panel via a panel joining assembly to substantially prevent moisture from entering the modular structure. An upper roof panel coupled to the center compartment is joined to first and second lower roof panels coupled to the first side compartment and the second side compartment, respectively, via first structural joining assemblies so that the upper roof panel is elevated relative to the first and second lower roof panels to substantially prevent moisture from entering the modular structure.

19 Claims, 14 Drawing Sheets

(56) References Cited

U.S. PATENT DOCUMENTS

| | | | | |
|---|---|---|---|---|
| 5,533,313 | A * | 7/1996 | Pike et al. | 52/712 |
| 5,966,956 | A * | 10/1999 | Morris et al. | 62/259.1 |
| 6,564,523 | B1 * | 5/2003 | Iole et al. | 52/521 |
| 6,675,545 | B2 * | 1/2004 | Chen et al. | 52/586.1 |
| 6,772,563 | B2 * | 8/2004 | Kuhn | 52/67 |
| 6,983,567 | B2 * | 1/2006 | Ciotti | 52/79.5 |
| 7,418,802 | B2 * | 9/2008 | Sarine et al. | 52/79.5 |
| 7,520,708 | B2 * | 4/2009 | Ciulis et al. | 411/34 |
| 7,784,845 | B2 * | 8/2010 | Kim et al. | 296/26.01 |
| 7,805,891 | B2 * | 10/2010 | Lozier et al. | 52/23 |
| 8,087,206 | B1 * | 1/2012 | Worley et al. | 52/549 |
| 8,347,560 | B2 * | 1/2013 | Gyory et al. | 52/79.5 |
| 8,438,791 | B1 * | 5/2013 | Lashley et al. | 52/91.3 |
| 8,464,478 | B2 * | 6/2013 | Tweedie | 52/173.3 |
| 8,590,215 | B2 * | 11/2013 | Damichey | 52/79.9 |
| 2002/0166289 | A1 * | 11/2002 | Oviedo-Reyes | 52/4 |
| 2006/0032175 | A1 * | 2/2006 | Chen et al. | 52/578 |
| 2009/0223144 | A1 * | 9/2009 | Leahy | 52/79.1 |
| 2010/0325971 | A1 * | 12/2010 | Leahy | 52/79.1 |

* cited by examiner

RAPID ASSEMBLY OF A MODULAR STRUCTURE

GOVERNMENT LICENSE RIGHTS

This invention was made with government support under Contract No. N00164-05-C-6084 awarded by the U.S. Navy which is a branch of the U.S. Department of Defense. The invention was further made with government support under Contract No. N61331-10-C-0014 also awarded by the U.S. Navy.

FIELD OF THE INVENTION

This invention relates to modular structure, and more particularly, to apparatus and methods for rapid assembly of modular structures.

BACKGROUND OF THE INVENTION

In some circumstances, particularly in military applications, it may be desirable to provide temporary shelters for personnel and/or equipment. For example, it is desirable to provide a temporary shelter for military personnel who are being transported on a military vehicle, such as a hovercraft, that does not have sufficient cabin space for the military personnel to safely reside during transport. The temporary shelter is assembled on the deck of the military vehicle and protects the military personnel during transport.

Typically, the applications for the temporary shelters dictate that the temporary shelters be assembled rapidly without burdening the assemblers with a complex assembly process, yet provide an adequate shelter for the personnel and/or equipment housed in the temporary shelter. For example, the temporary shelters are often times assembled in a remote location to provide shelter for personnel and/or equipment during execution of short-term missions. The total amount of time the personnel are in the remote location is often times minimal so the portion of time committed in the assembly of the shelter has to be minimized. The temporary shelter is also required to provide adequate protection for the personnel and/or equipment by, for example, providing protection from weather elements, fire, and/or high sound levels. A complex assembly process of the temporary shelter adds to the amount of time allotted to the assembly of the temporary shelter, yet the assembly process cannot be simplified to the point that the temporary shelter no longer provides an adequate shelter.

Conventional temporary shelters, such as conventional personnel transport modules (PTM) used in the transport of military personnel, typically have issues that include but are not limited to corrosion, water leakage, and/or difficulty in assembly. The conventional PTM is assembled with panels made of a composite material that includes a foam inner layer that is between two outer layers of aluminum. The aluminum is bounded to the foam with polyurethane. The polyurethane absorbs moisture and then delaminates resulting in corrosion of the conventional PTM. The conventional PTM also does not include a moisture absorbing material between each panel to protect the conventional PTM from leaking moisture into the conventional PTM.

The panels of the conventional PTM are assembled together with ratchet locks. Each respective panel must be directly aligned with each other panel for the ratchet locks to sufficiently lock each respective panel together in forming the conventional PTM. The ratchet locks fail to provide tolerance levels in the alignment of each respective panel that would enable each panel to not have to be directly aligned with each other for the ratchet locks to sufficiently lock each panel together. The difficulty provided in directly aligning each respective panel with each other complicates the assembly process and adds unnecessary time in assembling the conventional PTM. Therefore, an effective means to provide and assemble a modular shelter that can be easily assembled but yet provide adequate protection is needed.

SUMMARY OF THE INVENTION

The present invention provides a modular structure for housing personnel and/or equipment including a center compartment formed by a first set of panels from a plurality of panels. The modular structure also includes a first side compartment coupled to the center compartment formed by a second set of panels from the plurality of panels. The modular structure also includes a second side compartment coupled to the center compartment opposite of the first side compartment formed by a third set of panels from the plurality of panels. Each panel from the plurality of panels is joined to each respective adjacent panel via a panel joining assembly to substantially prevent moisture from entering the modular structure. The center compartment includes an upper roof panel that is coupled to the center compartment and configured to be a roof for the center compartment. The first side compartment includes a first lower roof panel that is coupled to the first side compartment and configured to be a roof for the first side compartment. The second side compartment includes a second lower roof panel that is coupled to the second side compartment and configured to be a roof for the second side compartment. The upper roof panel is joined to each of the first and second lower roof panels via a roof joining assembly so that the upper roof panel is elevated relative to the first lower roof panel and the second lower roof panel to substantially prevent moisture from entering the modular structure.

The present invention also provides a modular structure for housing personnel and/or equipment, including a plurality of bays formed by a plurality of panels so that each panel from the plurality of panels is joined to each respective adjacent panel via a panel joining assembly to substantially prevent moisture and/or water penetration from entering the modular structure. Each bay includes a center compartment formed by a first set of panels from the plurality of panels. Each bay also includes a first side compartment coupled to the center compartment formed by a second set of panels from the plurality of panels. Each bay also includes a second side compartment coupled to the center compartment opposite of the first side compartment formed by a third set of panels from the plurality of panels. Each bay also includes an upper roof panel coupled to the center compartment and configured to be a roof for the center compartment. Each bay also includes a first lower roof panel coupled to the first side compartment and configured to be a roof for the first side compartment. Each bay also includes a second lower roof panel coupled to the second side compartment and configured to be a roof for the second side compartment. The upper roof panel is joined to each of the first and second lower roof panels via a roof joining assembly so that the upper roof panel is elevated relative to the first lower roof panel and the second lower roof panel to substantially prevent moisture and/or water penetration from entering the modular structure.

A method for forming a modular structure for housing personnel and/or equipment is also provided. The method starts with forming a center compartment by a first set of panels from a plurality of panels. The method further includes forming a first side compartment coupled to the center compartment formed by a second set of panels from the plurality of panels. The method includes further forming a second side compartment coupled to the center compartment opposite the first side compartment formed by a third set of panels from the plurality of panels. The method further includes joining each panel from the plurality of panels to each respective adjacent panel via a panel joining assembly to substantially prevent moisture from entering the modular structure. The method further includes coupling an upper roof panel to the center compartment so that the upper roof panel is a roof for the center compartment. The method further includes coupling a first lower roof panel to the first side compartment so that the first lower roof panel is a roof for the first side compartment. The method further includes coupling a second lower roof panel to the second side compartment so that the second lower roof panel is a roof for the second side compartment. The method further includes joining the upper roof panel to each of the first and second lower roof panels via a roof joining assembly so that the upper roof panel is elevated relative to the first and second lower roof panels to substantially prevent moisture from entering the modular structure.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention. Additionally, the left most digit(s) of a reference number identifies the drawing in which the reference number first appears.

Figure 1:
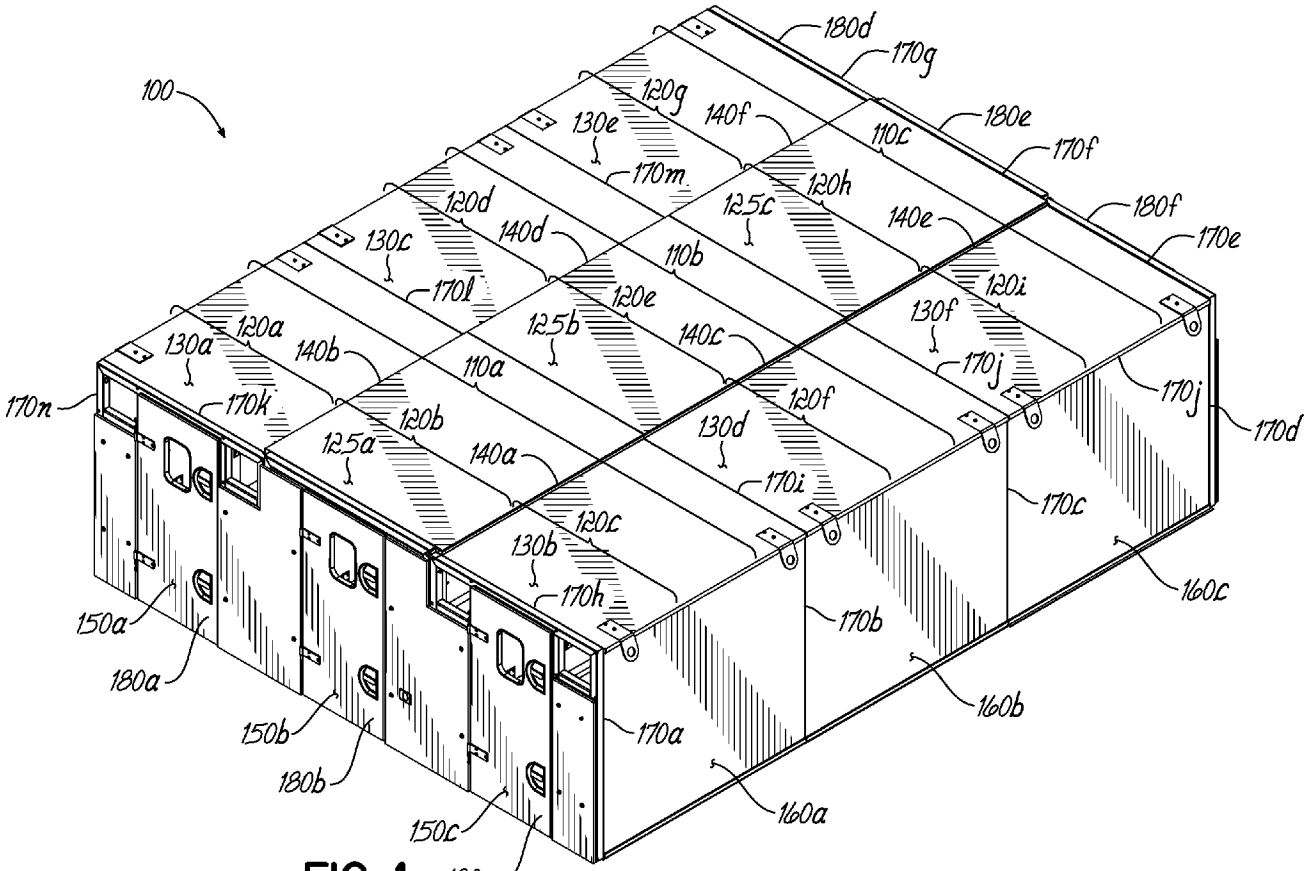
FIG. 1 is a perspective view of an exemplary modular structure in accordance with an embodiment of the disclosure.

The present disclosure will now be described with reference to the accompanying drawings. In the drawings, like reference numbers generally indicate identical, functionally similar, and/or structurally similar elements. The drawing in which an element first appears is indicated by the leftmost digit(s) in the reference number.

DETAILED DESCRIPTION

The following Detailed Description refers to accompanying drawings to illustrate exemplary embodiments consistent with the present disclosure. References in the Detailed Description to "one exemplary embodiment," "an exemplary embodiment," "an example exemplary embodiment," etc., indicate that the exemplary embodiment described can include a particular feature, structure, or characteristic, but every exemplary embodiment does not necessarily include the particular feature, structure, or characteristic. Moreover, such phrases are not necessarily referring to the same exemplary embodiment. Further, when a particular feature, structure, or characteristic is described in connection with an exemplary embodiment, it is within the knowledge of those skilled in the relevant art(s) to affect such feature, structure, or characteristic in connection with other exemplary embodiments whether or not explicitly described.

The exemplary embodiments described herein are provided for illustrative purposes, and are not limiting. Other exemplary embodiments are possible, and modifications can be made to exemplary embodiments within the scope of the present disclosure. Therefore, the Detailed Description is not meant to limit the present disclosure. Rather, the scope of the present disclosure is defined only in accordance with the following claims and their equivalents.

The following Detailed Description of the exemplary embodiments will so fully reveal the general nature of the present disclosure that others can, by applying knowledge of those skilled in the relevant art(s), readily modify and/or adapt for various applications such exemplary embodiments, without undue experimentation, without departing from the scope of the present disclosure. Therefore, such adaptations and modifications are intended to be within the meaning and plurality of equivalents of the exemplary embodiments based upon the teaching and guidance presented herein. It is to be understood that the phraseology or terminology herein is for the purpose of description and not limitation, such that the terminology or phraseology of the present specification is to be interpreted by those skilled in relevant art(s) in light of the teachings herein.

For a more efficient modular structure and assembly thereof, the present invention implements a roof and panel joining assemblies with modular panels to create a substantially moisture proof structure that is scalable and easily assembled. The modular structure is assembled with prefabricated modular panels that are transported as individual pieces to the location where the modular structure is to be assembled and then assembled into the modular structure. Each modular panel of the modular structure is implemented as a supporting structure for the modular structure, i.e., a wall, roof, and/or floor for the modular structure. Each modular panel may be sized accordingly based on structural loading requirements, fire requirements, and/or any other design and/or performance requirements that will be apparent to those skilled in the relevant art(s) without departing from the scope of the present disclosure.

One of ordinary skill in the art will recognize that the modular structure is scalable in that an already assembled base modular structure may be expanded by adding additional modular panels. For example, the base modular structure is assembled as three compartments in a single row creating a one by three base modular structure. Each compartment is a section of the modular structure that is divided from each other compartment of the modular structure by modular panels, i.e. a first side panel, a second side panel, a roof panel, and a floor panel. Three additional compartments in a second single row adjacent to the original three compartments are then added to the base modular structure. Thus, the scaled modular structure now includes six compartments dispersed in a two by three modular structure.

The panel joining assembly is implemented in joining each modular panel of the modular structure together. The panel joining assembly traps a shear pin inside a gasket that joins adjacent modular panels to substantially prevent moisture from intruding into the modular structure while providing a fitting tolerance between each adjacent modular structure that provides ease in assembly. The fitting tolerance between each adjacent module structure provides flexibility in aligning the modular structures so that each modular structure is not required to be directly aligned with each other modular structure. For ease of discussion, the joining technique implemented between modular panels will simply be referred to as the panel joining assembly.

In order to further improve upon the moisture tightness of the modular structure, a base modular structure includes three compartments joined together in a single row forming a bay. A bay is the minimum amount of modular panels required to standalone as a modular structure. The roof of the center compartment overlaps each roof of each of the two adjacent compartments to the center compartment. For ease of discussion, the roof of the center compartment overlapping each roof of each of the two adjacent compartments will be simply referred to as the upper roof while each roof of the two adjacent compartments will be simply referred to as the lower roofs. In the overlap region, a gasket is placed between the upper roof and the lower roof. A metal sleeve is inserted through the lower roof, the gasket and the upper roof in the overlap region. A bolt that may be self-aligned is inserted through the metal sleeve and tightened to compress the lower roof, the gasket, and the upper roof together forming a seal. The metal bolt confines the bolt and resists the shear load induced on the modular structure due to lateral racking. For ease of discussion, the joining technique implemented in the overlapping portion of the upper roof and each of the lower roofs will be simply referred to as the roof joining assembly. The overlapping of the upper roof and the lower roofs provides a path for moisture to run off of the roof of the modular structure rather than accumulating on the roof.

As the following description will show in detail, the disclosed invention takes advantage of these properties to protect the inside of the modular structure from moisture while providing ease in assembly. This serves to improve the overall performance of the modular structure, particularly in applications that require rapid assembly while being exposed to severe environmental conditions. In the description that follows, even though references may be made to use in military applications or as a PTM, it should be understood that the system and method apply to a wide variety of applications that may require a modular structure with rapid assembly and adequate protection for personnel and/or equipment stored within. For example, the system and method may find use in aid relief in the aftermath of natural disasters.

FIG. 1 depicts an example modular structure 100. The example modular structure 100 includes a first bay 110*a*, a second bay 110*b*, and a third bay 110*c*. Each bay 110*a* through 110*c* includes compartments positioned in a row to form each respective bay 110*a* through 110*c*. The first bay 110*a* includes compartments 120*a*, 120*b*, and 120*c*. The second bay 110*b* includes compartments 120*d*, 120*e*, and 120*f*. The third bay includes compartments 120*g*, 120*h*, and 120*i*. Thus, the example modular structure 100 includes nine total compartments 120*a* through 120*i* arranged in three bays 110*a* through 110*c* as depicted in a three compartment by three compartment configuration.

As noted above, the modular structure is assembled as a base modular structure and then is scalable so that additional modular structures may be added until the final modular structure is reached. Regarding the example modular structure 100, the example modular structure 100 is initially assembled by formulating three compartments into a single bay. After the modular structure 100 is initially formulated into the single bay, then the modular structure 100 is a base modular structure and may stand alone. No additional compartments and/or bays are required to be added to the base modular structure of the example modular structure 100 for the base modular structure to adequately protect personnel and/or equipment housed within the base modular structure. However, additional bays may be then added to the base modular structure in order to increase the size of the example modular structure 100.

For example, the example modular structure 100 is formulated by initially assembling compartments 120*d*, 120*e*, and 120*f* into the second bay 110*b* forming the base modular structure. After the second bay 110*b* is assembled as the base modular structure, the second bay 110*b* may stand alone without any additional compartments to adequately protect personnel and/or equipment housed within the second bay 110*b*. However, to increase the size of the example modular structure 100, the example modular structure 100 is scaled in that the compartments 120*a*, 120*b*, and 120*c* are formulated to assemble the first bay 110*a* and the compartments 120*g*, 120*h*, and 120*i* are formulated to assemble the third bay 110*c*. Rather than being a single bay as depicted by the second bay 110*b*, the example modular structure 100 has been scaled to increase in size to also include the first bay 110*a* and the third bay 110*c*.

Although, the base modular structure for the example modular structure 100 is depicted as a single bay that is formulated by three compartments positioned in a row in FIG. 1, the base modular structure for the example modular structure 100 may be scaled to include any quantity of bays each with three compartments positioned so that the example modular structure 100 is three compartments across with any quantity of bays deep that will be apparent to those skilled in the relevant art(s) without departing from the scope of the present disclosure.

As noted above, in order to improve upon the moisture tightness of the example modular structure 100, each bay 110*a* through 110*c* includes an upper roof 125*a* through 125*c* that overlaps adjacent lower roofs 130*a* through 130*f*. For example, the first bay 110*a* includes upper roof 125*a* that overlaps adjacent roofs 130*a* and 130*b*. The second bay 110*b* includes upper roof 125*b* that overlaps adjacent roofs 130*c* and 130*d*. The third bay 110*c* includes upper roof 125*c* that overlaps adjacent roofs 130*e* and 130*f*.

The overlapping of upper roofs 125*a* through 125*c* over adjacent lower roofs 130*a* through 130*f* provides a path for moisture to run off of the roof of the example modular structure 100 rather than accumulating on the roof. The higher positioning of the upper roofs 125*a* through 125*c* in the center of the example modular structure 100 relative the lower positioning of the adjacent roofs 130*a* through 130*f* on the sides of the example modular structure 100 provides a slope. The slope provides a pathway for water accumulating on the higher positioned upper roofs 125*a* through 125*c* to flow down to the lower positioned adjacent roofs 130*a* through 130*f* and then off of the roof of the example modular structure 100 altogether.

Each roof joining assembly 140*a* through 140*f* positioned in the overlapping portion of each upper roof 125*a* through 125*c* and each adjacent lower roof 130*a* through 130*f* also substantially prevents moisture from entering the example modular structure 100. As noted above, each roof joining assembly 140*a* through 140*f* includes a gasket positioned in the overlap region between each upper roof 125*a* through 125*c* and each lower roof 130*a* through 130*f*. Each upper roof 125*a* through 125*c*, each gasket, and each lower roof 130*a* through 130*f* are then bolted together to form a seal that substantially precludes moisture from entering the inside of the example modular structure 100. Further, each upper roof 125*a* through 125*c* conceals each roof joining assembly 140*a* through 140*f* to limit the amount of moisture that each roof joining assembly 140*a* through 140*f* is exposed to so that the material properties of each roof joining assembly 140*a* through 140*f* are preserved further increasing the performance of each in excluding moisture.

Further, in order to improve upon moisture tightness of the example modular structure 100, each adjacent modular panel included in the example modular structure 100 may be joined via panel joining assembly 170*a* through 170*n*. Each panel joining assembly 170*a* through 170*n* also includes shear pins trapped inside a gasket that joins each adjacent modular structure to formulate a seal that substantially excludes moisture from entering the inside of the example modular structure 100. For example in examining compartments 120*c*, 120*f*, and 120*i*, the lower roof 130*d* of compartment 120*f* is structurally joined to the lower roof 130*b* of compartment 120*c* via panel joining assembly 170*i*. The lower roof 130*d* of compartment 120*f* is structurally joined to the lower roof 130*f* of compartment 120*i* via panel joining assembly 170*j*. The side wall 160*b* of compartment 120*f* is structurally joined to the side wall 160*c* of compartment 120*i* via panel joining assembly 170*c*.

End panels 180*a* through 180*f* provide the end structures for the example modular structure 100. A first set of end panels for the example modular structure 100 include a passage way into the example modular structure as depicted by end panels 180*a*, 180*b*, and 180*c* that include doors 150*a*, 150*b*, and 150*c*, respectively. Doors 150*a*, 150*b*, and 150*c* provide entryways into the example modular structure 100 for personnel to easily enter and/or exit the example modular structure 100. A second set of end panels enclose the example modular structure 100 on an opposite end from the example modular structure as the first set of end panels as depicted by end panels 180*d*, 180*e*, and 180*f*.

Examples of the modular panels included in the example modular structure 100 as shown in FIG. 1 include the upper roofs 125*a* through 125*c*, the lower roofs 130*a* through 130*f*, side panels 160*a* through 160*c*, and end panels 180*a* through 180*f*. The structural materials of the modular panels that are assembled to form the example modular structure 100 may include but are not limited to concrete, metal, composite material, wood, fiberglass, steel, aluminum, and/or any other structurally viable material sufficient to protect the personnel and/or equipment housed inside the example modular structure 100 that will be apparent to those skilled in the relevant art(s) without departing from the scope of the present disclosure.

The example modular structure 100 may be erected on land, offshore platforms, ship decks, amphibious vehicles, land vehicles, aerial platforms, aerial vehicles, and/or any other type of surface that is capable of supporting the example modular structure 100 that will be apparent to those skilled in the relevant art(s) without departing from the scope of the present disclosure. The example modular structure 100 may be constructed using exclusively manpower without the assistance of machines such as a crane and/or forklift, using exclusively machines such as a crane and/or forklift, any combination thereof, and/or any other type of construction methods that can be executed in an efficient manner that will be apparent to those skilled in the relevant art(s) without departing from the scope of the present disclosure.

Each of the modular panels and parts required to assemble the example modular structure 100, which includes but is not limited to the upper roofs 125*a* through 125*c*, the lower roofs 130*a* through 130*f*, the side walls 160*a* through 160*c*, the doors 150*a* through 150*c*, and the roof joining assembly 140*a* through 140*f*, may be packed into a transferable kit that enables the modular panels and parts to be easily transferred to the location that the example modular structure 100 is to be assembled. Each of the modular panels may be substantially flat without any extruding objects and/or pieces to so that the each of the modular panels may be easily stowed and packed into the transferable kit.

The modular panels and parts included in the example modular structure 100 are interchangeable, which increases the ease of assembly. For example, the lower roof 130*a* located on the compartment 120*a* can also be placed on the compartment 120*i* where the lower roof 130*f* is currently depicted in FIG. 1. Further, aluminum sheets may be attached to each modular panel relative to the inside of the example modular structure 100 to provide fire resistance to fires external to the example modular structure 100. Although aluminum is implemented, any type of fire resistant material may also be implemented that will be apparent to those skilled in the relevant art(s) without departing from the scope of the present disclosure. Further, the modular panels may be constructed with a corrosion-resistant composite material to prevent corrosion. Although a corrosion-resistant composite material is implemented, any type of corrosion-resistant material may also be implemented that will be apparent to those skilled in the relevant art(s) without departing from the scope of the present disclosure.

The following discussion below regarding FIGS. 2A through 7B discloses in detail how an example modular structure 100 may be rapidly assembled according to an exemplary embodiment of the present disclosure. The present disclosure is not limited to this operational description as disclosed in FIGS. 2A through 7B. Rather, it will be apparent to persons skilled in the relevant art(s) from the teaching herein that other methods of rapid assembly are within the scope of the present disclosure.

Figure 2A:
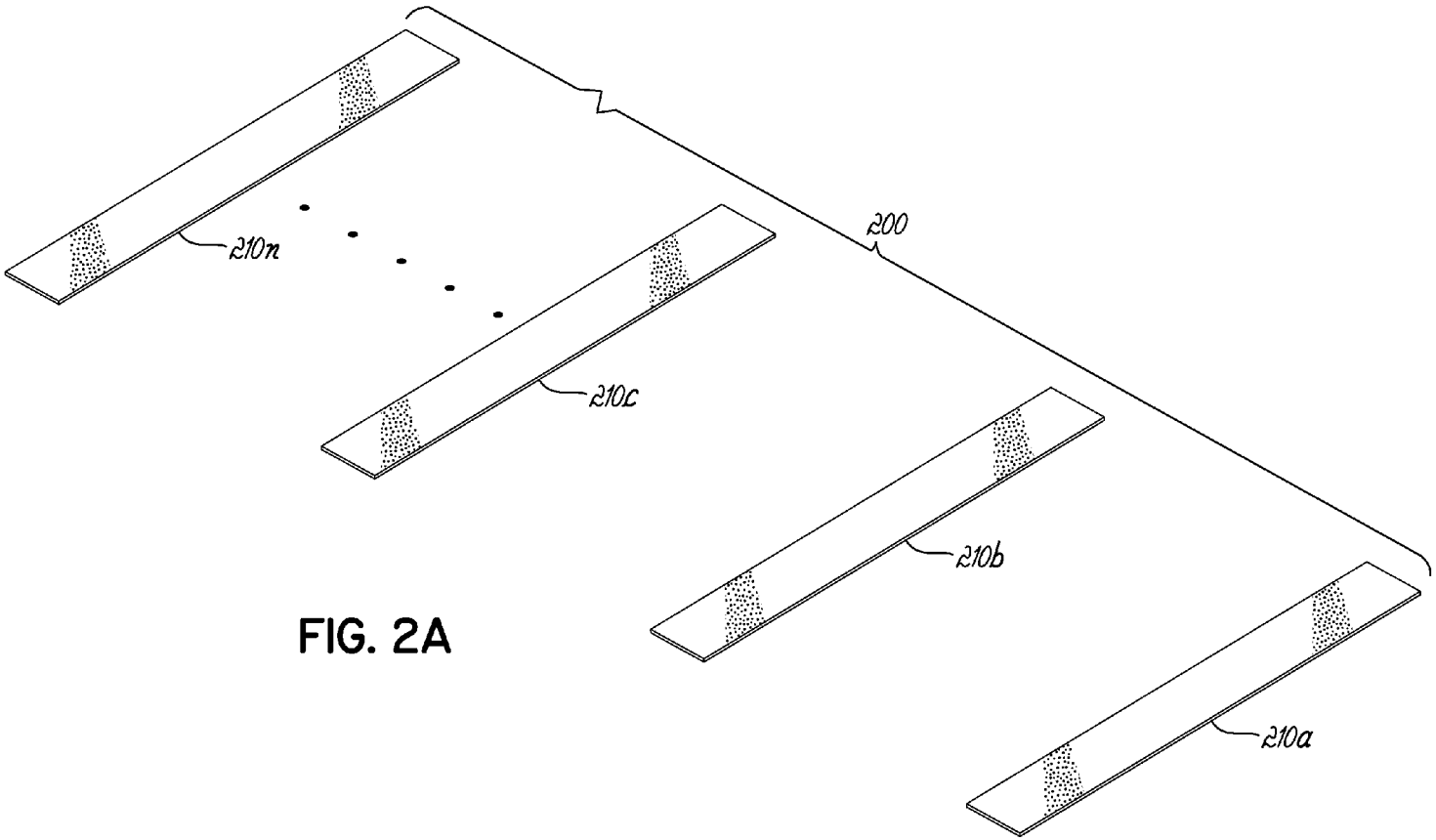
FIG. 2A is a perspective view of an exemplary floor gasket configuration in accordance with an embodiment of the disclosure.

Referring to FIG. 2A, in which like reference numerals are used to refer to like parts, a floor gasket configuration 200 is shown. The floor gasket configuration 200 includes a plurality of floor gaskets 210*a* through 210*n* where n is an integer equal to or greater than one. The plurality of floor gaskets 210*a* through 210*n* is placed on a surface that the example modular structure 100 is to be erected on. As noted above, the surface for the example modular structure 100 may include but is not limited to a ship deck such as the deck of a hovercraft, land, etc. Often times the surface that the example modular structure 100 is to be erected on is not flat and/or level but rather includes deflections. Simply erecting the example modular structure 100 on a deflected surface may weaken the overall support of the example modular structure 100. The plurality of floor gaskets 210*a* through 210*n* absorbs any surface deflections the example modular structure 100 may be erected on and as a result provides stability to the example modular structure 100.

Figure 2B:
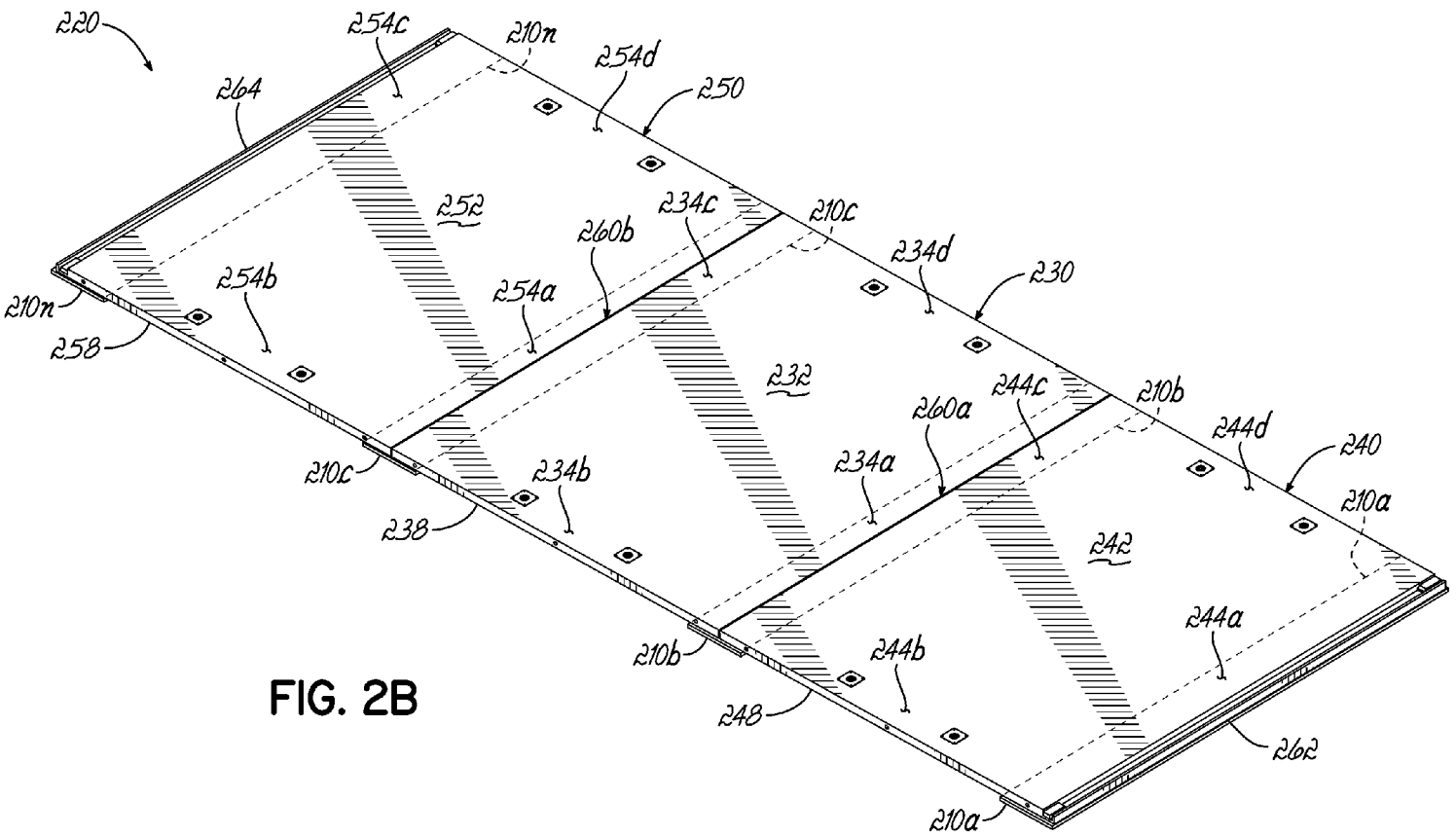
FIG. 2B is a perspective view of an exemplary floor configuration in accordance with an embodiment of the disclosure.

Referring to FIG. 2B, in which like reference numerals are used to refer to like parts, a floor configuration 220 is shown. The floor configuration 220 includes a center floor panel 230, a first side floor panel 240, and a second side floor panel 250. The center floor panel 250 includes a top surface 232, a first side edge 234*a*, a second side edge 234*b*, a third side edge 234*c*, a fourth side edge 234*d*, and a bottom surface 238. The first side floor panel 240 includes a top surface 242, a first side edge 244*a*, a second side edge 244*b*, a third side edge 244*c*, a fourth side edge 244*d*, a bottom surface 248, and a groove 262. The second side floor panel 250 includes a top surface 252, a first side edge 254*a*, a second side edge 254*b*, a third side edge 254*c*, a fourth side edge 254*d*, a bottom surface 258, and a groove 264.

The bottom surface 238 of the center floor panel 230 is positioned on the plurality of floor gaskets 210*a* through 210*n* so that the bottom surface 238 of the first side edge 234*a* and the third side edge 234*c* of the center floor panel 230 are placed onto an individual floor gasket 210*a* through 210*n*. For example, the first side edge 234*a* of the center floor panel 230 is placed onto the floor gasket 210*b* while the third side edge 234*c* is placed onto the floor gasket 210*c*. The center floor panel 230 is to act as the center floor panel for a bay included in the example modular structure 100. For example, the center floor panel 230 is the center floor panel in the second bay 110*b* in that the center floor panel 230 is the floor panel for the compartment 120*e*.

The first side floor panel 240 is positioned on the plurality of floor gaskets 210*a* through 210*n* adjacent to the center floor panel 230. For example, the third side edge 244*c* of the first side floor panel 240 is positioned adjacent to the first side edge 234*a* of the center floor panel 230. A bottom surface 248 of the first side floor panel 240 is positioned on the plurality of floor gaskets 210*a* through 210*n* so that the bottom surface 248 of the first side edge 244*a* and the third side edge 244*c* of the first side floor panel 240 are placed onto an individual floor gasket 210*a* through 210*n*. For example, the first side edge 244*a* is placed onto the floor gasket 210*a* while the third side edge 244*c* is placed onto the floor gasket 210*b*.

The second side floor panel 250 is positioned on the plurality of floor gaskets 210*a* through 210*n* adjacent to the center floor panel 230 on the opposite side of the center floor panel 230 from the first side floor panel 240. For example, the first side edge 254*a* of the second side floor panel 250 is positioned adjacent to the third side edge 234*c* of the center floor panel 230. A bottom surface 258 of the second side floor panel 250 is positioned onto the plurality of floor gaskets 210*a* through 210*n* so that the bottom surface 258 of the first side edge 254*a* and the third side edge 254*c* of the second side floor panel 250 are placed onto an individual floor gasket 210*a* through 210*n*. For example, the first side edge 254*a* is placed onto the floor gasket 210*c* while the third side edge 254*c* is placed onto the floor gasket 210*n*.

The first and second side floor panels 240 and 250 are to act as the side floor panels for a bay included in the example modular structure 100. For example, the first side floor panel 240 is the side floor panel in the second bay 110*b* in that the first floor panel 240 is the floor panel for the compartment 120*f*. The second side floor panel 250 is the floor panel in the second bay 110*b* in that the second side floor panel 250 is the floor panel for the compartment 120*d*.

The first side floor panel 240 is joined to the center floor panel 230 via panel joining assembly 260*a*. The second side floor panel 250 is joined to the center side floor panel 230 via panel joining assembly 260*b*. As noted above, each modular panel included in the example modular structure 100 is joined via the panel joining assembly as shown with the panel joining assemblies 170*a* through 170*n* in FIG. 1. Panel joining assemblies 260*a* and 260*b* shown in FIG. 2B are substantially similar to the panel joining assemblies 170*a* through 170*n* in FIG. 1.

Figure 2C:
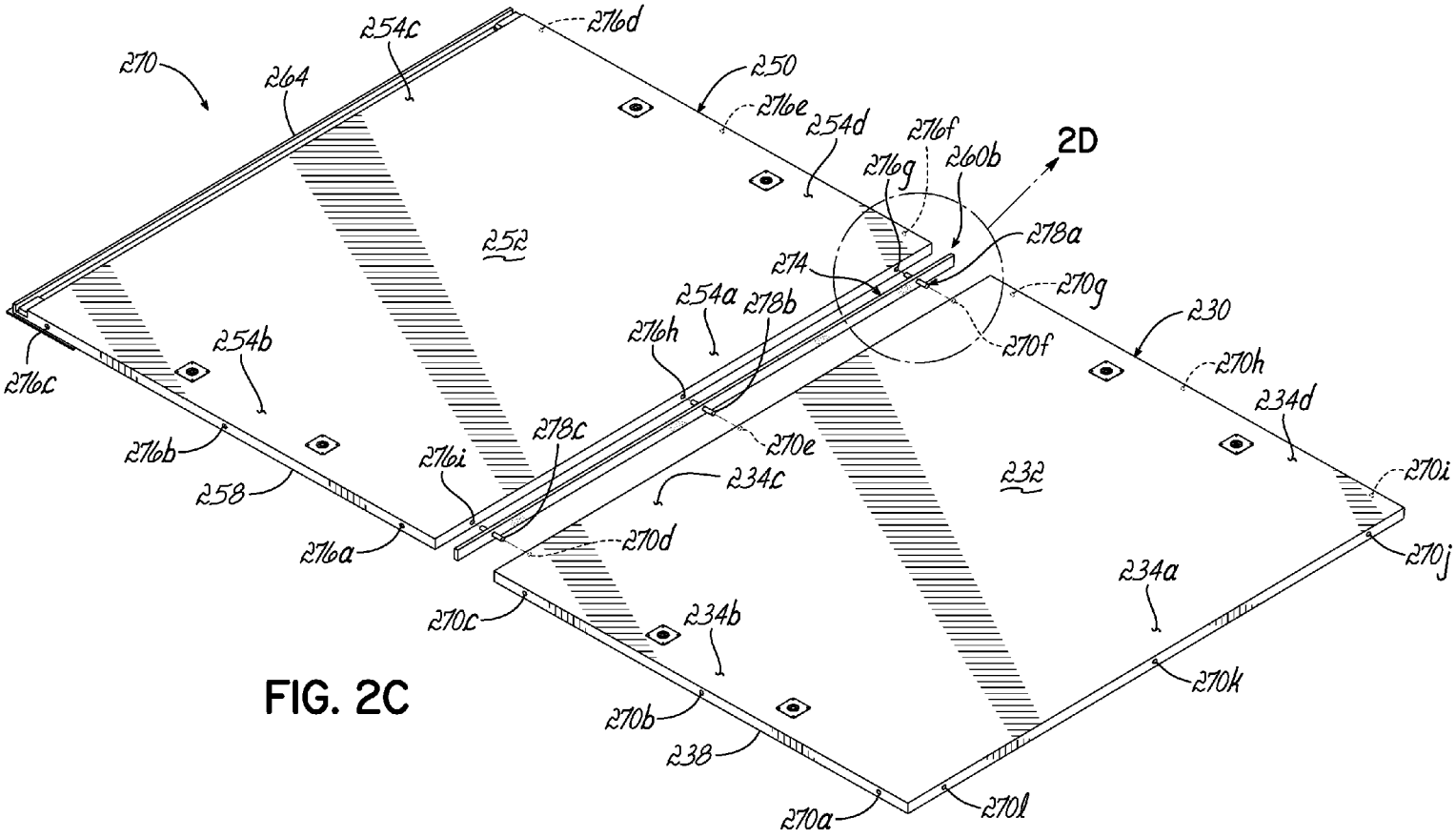
FIG. 2C is a perspective view of an exemplary structural joining configuration in accordance with an embodiment of the disclosure.

Referring to FIG. 2C, in which like reference numerals are used to refer to like parts, an example structural joining configuration 270 is shown. The structural joining configuration 270 depicts the joining of the central floor panel 230 to the second side floor panel 250 via panel joining assembly 260*b*. The panel joining assembly 260*b* includes a gasket 274 and a plurality of shear pins 278*a* through 278*c*.

Figure 2D:
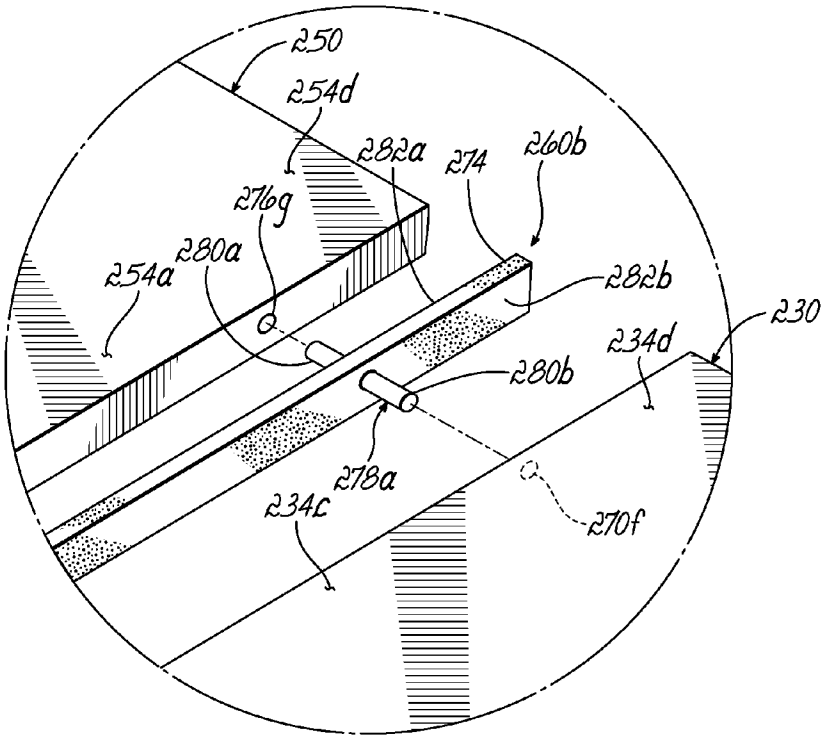
FIG. 2D is an enlarged detail of encircled area 2D taken from FIG. 2C of an exemplary panel joining assembly in accordance with an embodiment of the disclosure.

Referring to FIG. 2D, in which area 2D of FIG. 2C is enlarged and in which like reference numerals are used to refer to like parts, the structural joining assembly 260*b* is shown. Shear pin 278*a* is trapped in the gasket 274 in that a first end 280*a* of the shear pin 278*a* protrudes through a first side 282*a* of the gasket 274 and a second end 280*b* of the shear pin 278 protrudes through the second side 282*b* of the gasket 274. The gasket 274 may be made of a silicon material with substantial thickness and low durometer and/or any other material with characteristics that may provide a substantial seal to moisture that will be apparent to those skilled in the relevant art(s) without departing from the scope of the present disclosure.

In an embodiment, the shear pins 278*a* through 278*c* pass substantially through the gasket 274 so that the first end 280*a* and the second end 280*b* of the shear pins 278*a* through 278*c* are joined. In another embodiment, the shear pins 278*a* through 278*c* do not pass substantially through the gasket 274 so that the first end 280*a* and the second end 280*b* of the shear pins 278*a* through 278*c* are not joined but rather have a portion of the gasket 274 in between each. In another embodiment, the shear pins 278*a* through 278*c* include a single piece of material joining the first end 280*a* and the second end 280*b*. In another embodiment, the shear pins 278*a* through 278*c* include segmented pieces of material joining the first end 280*a* and the second end 280*b*. The shear pins 278*a* through 278*c* may include any type of structure that can be trapped in the gasket 274 so that the first end 280*a* and the second end 280*b* protrude outward away from the gasket 274 that will be apparent to those skilled in the relevant art(s) without departing from the scope of the present disclosure.

Returning to FIG. 2C, the central floor panel 230 includes a plurality of bores 270*a* through 270*l* positioned on each side edge 234*a* through 234*d* of the central floor panel 230. For example, bores 270*d* through 270*f* are positioned on the third side edge 234*c*. The second end 280*b* of each shear pin 278*a* through 278*c* is placed into the corresponding bore 270*d* through 270*f* positioned on the third side edge 234*c* so that the gasket 274 is fitted onto the third side edge 234*c*. For example, the second end 280*b* for shear pin 278*a* is placed into bore

270*f*. The second end 280*b* for shear pin 278*b* is placed into bore 270*e*. The second end 280*b* for shear pin 278*c* is placed into bore 270*d*.

The second side floor panel 250 includes a plurality of bores 276*a* through 276*h* positioned on the first side edge 254*a*, the second side edge 254*b*, and the fourth side edge 254*c* of the second side floor panel 250. For example, bores 276*g* through 276*i* are positioned on the first side edge 254*a*. The first end 280*a* of each shear pin 278*a* through 278*c* is placed into the corresponding bore 276*g* through 276*i* positioned on the first side edge 254*a* so that the gasket 274 is fitted onto the first side edge 254*a*. For example, the first end 280*a* for shear pin 278*a* is placed into bore 276*g*. The first end 280*a* for shear pin 278*b* is placed into bore 276*h*. The first end 280*a* for shear pin 278*c* is placed into bore 276*i*.

After the gasket 274 is fitted onto both the third side edge 234*c* of the central floor panel 230 and the first side edge 254*a* of the second side floor panel 250 as outlined above, the central floor panel 230 and the second side floor panel 250 are compressed together to trap each shear pin 278*a* through 278*c* within the gasket 274. As a result, the central floor panel 230 is joined to the second side floor panel 250 via the each corresponding shear pin 278*a* through 278*c* trapped inside the gasket 274 forming a substantially moisture tight seal between the central floor panel 230 and the second side floor panel 250. The substantially moisture tight seal substantially prevents moisture from entering the example modular structure 100 between the central floor panel 230 and the second side floor panel 250.

The panel joining assembly 260*a* may be formed between the central floor panel 230 and the first side floor panel 240 may be formed in a similar fashion as the panel joining assembly 260*b* explained above. Further, the panel joining assemblies 170*a* through 170*n* formed between adjacent modular structures included in the example modular structure 100 in FIG. 1 are likewise formed in a similar fashion as the panel joining assembly 260*b* explained above. For example, as shown in FIG. 2C, a panel joining assembly (not shown) similar to that of the gasket 274 and shear pin 278*a* through 278*c* configuration depicting the panel joining assembly 260*b* may be used to join the second side edge 234*b* of the central floor panel 230 to a side edge (not shown) of a second central floor panel (not shown) in forming another bay (not shown) to the bay (not shown) that includes the central floor panel 230.

Each modular panel included in the example modular structure 100 in FIG. 1 may include any quantity of bores positioned on each side of each modular structure necessary to form a substantially moisture tight seal by the panel joining assemblies 170*a* through 170*n* that will be apparent to those skilled in the relevant art(s) without departing from the scope of the present disclosure. Further, each panel joining assembly 170*a* through 170*n* may include any quantity of shear pins necessary to form a substantially moisture tight seal between adjacent modular panels that will be apparent to those skilled in the relevant art(s) without departing from the scope of the present disclosure.

Figure 3:
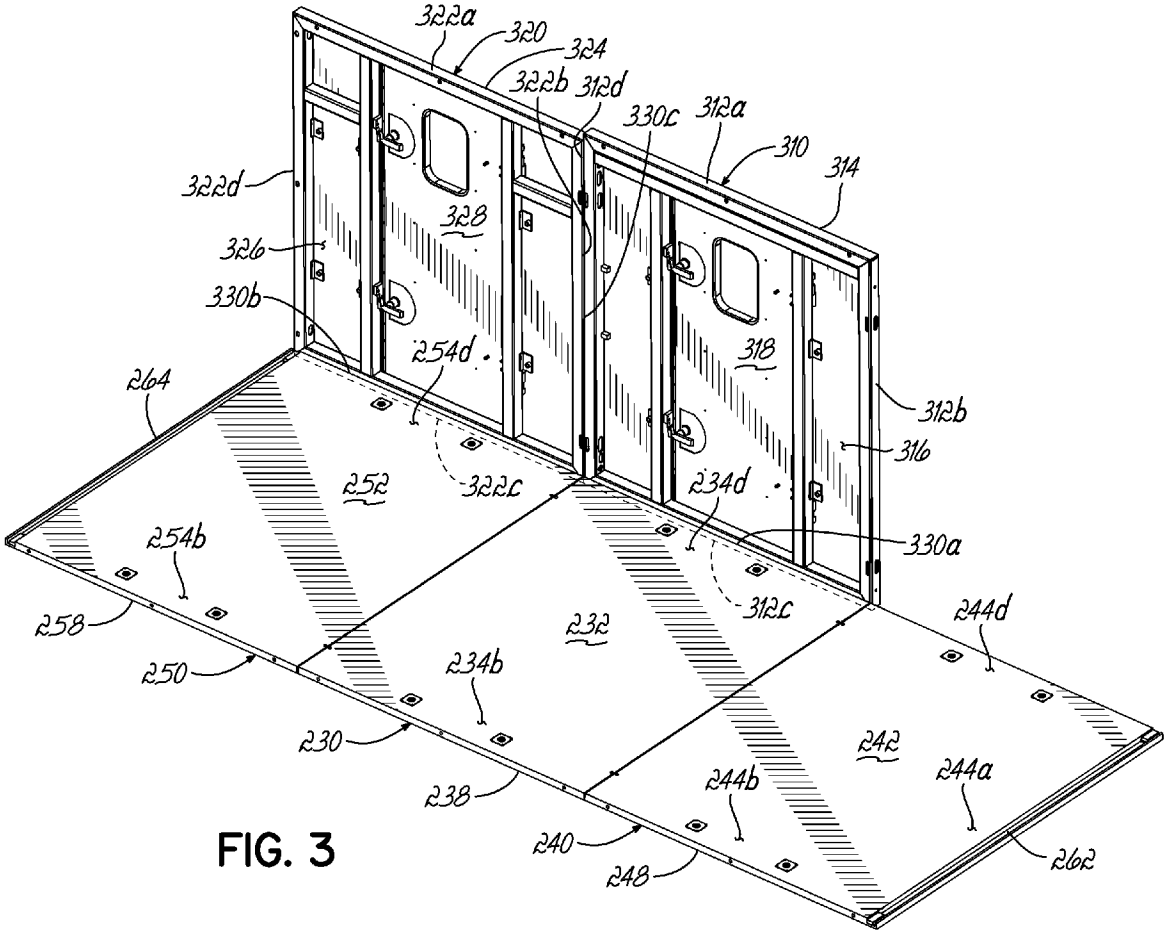
FIG. 3 is a perspective view of an exemplary end panel configuration in accordance with an embodiment of the disclosure.

Referring to FIG. 3, in which like reference numerals are used to refer to like parts, an end panel configuration 300 is shown. A first end panel 310 includes a first side edge 312*a*, a second side edge 312*b*, a third side edge 312*c*, a fourth side edge 312*d*, an outer portion 314 that faces the outside of the eventual modular structure, an inner portion 316 that faces the inside of the eventual modular structure, and a door 318. A second end panel 320 includes a first side edge 322*a*, a second side edge 322*b*, a third side edge 322*c*, a fourth side edge 322*d*, an outer portion 324 that faces the outside of the eventual modular structure, an inner portion 326 that faces the inside of the eventual modular structure, and a door 328.

First end panel 310 is positioned onto central floor panel 230 and second end panel 320 is positioned onto second side floor panel 250. The first and second end panels 310 and 320 are to act as the end panels for a bay included in the example modular structure 100. For example in FIG. 1, the first end panel 310 is the end panel 180*b*. The second end panel 320 is the end panel 180*c*. The first end panel 310 and the second end panel 320 include a passage way into the eventual modular structure being formed with doors 318 and 328. Although the first end panel 310 and the second end panel 320 are depicted as passage ways, the first end panel 310 and the second end panel 320 may also enclose the eventual modular structure being formed similar to the end panels 180*d* through 180*f* of the example modular structure 100.

The third side edge 312*c* of the first end panel 310 is joined to the fourth side edge 234*d* of the central floor panel 230 via panel joining assembly 330*a*. The third side edge 322*c* of the second end panel 320 is joined to the fourth side edge 254*d* of the second side floor panel 250 via panel joining assembly 330*b*. The fourth side edge 312*d* of the first end panel 310 is joined to the second side edge 322*b* of the second end panel 320 via panel joining assembly 330*c*. The panel joining assemblies 330*a* through 330*c* are substantially similar to the structural joining assembly 260*b* discussed in greater detail above.

Figure 4B:
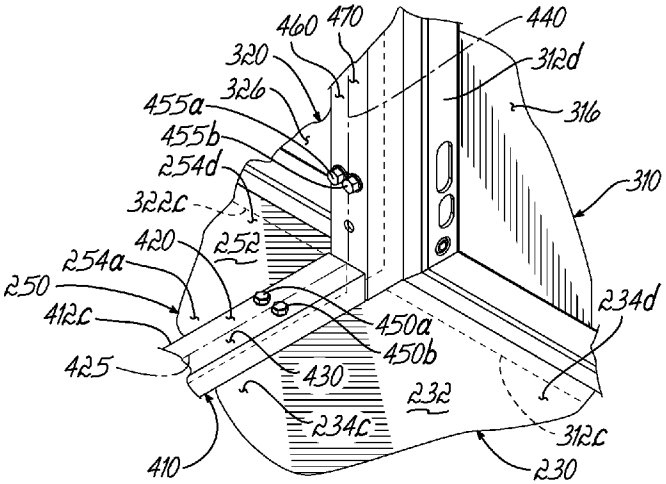
FIG. 4B is an enlarged detail of encircled area 4B taken from FIG. 4A of an exemplary detailed divider panel configuration in accordance with an embodiment of the disclosure.
Figure 4A:
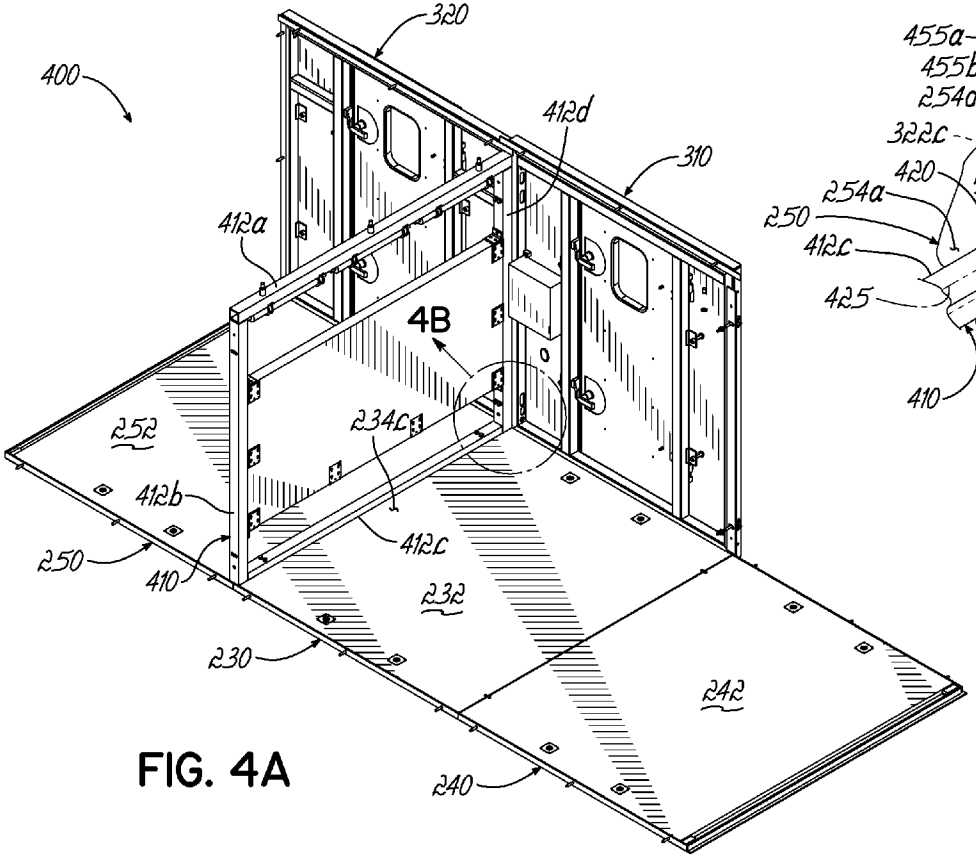
FIG. 4A is a perspective view of an exemplary divider panel configuration in accordance with an embodiment of the disclosure.

Referring now to FIG. 4A, in which like reference numerals are used to refer to like parts, a divider panel configuration 400 is shown. A first divider panel 410 includes a first side edge 412*a*, a second side edge 412*b*, a third side edge 412*c*, and a fourth side edge 412*d*. The first divider panel 410 is positioned onto central floor panel 230 and second floor end panel 250. The first divider panel 410 is positioned onto the first end panel 310 and the second end panel 320. The first divider panel 410 provides support for a bay included in the example modular structure 100. After the first divider panel 410 is installed in relation to the central floor panel 230, the second end floor panel 320, the first end panel 310, and the second end panel 320 as mentioned above, the divider panel configuration 400 may stand alone without any external support as the assembly of the structure is continued. For example, the divider panel configuration 400 may no longer require being physically held up by personnel assembling the structure after the divider panel 410 is installed.

Because the first divider panel 410 is substantially positioned internal to the divider panel configuration 400, structural joining assemblies such as panel joining assembly 260*b* as discussed in detail above, are not required for modular panels adjacent to the first divider panel 410. The first divider panel 410 is not exposed to moisture external to the divider panel configuration 400 and thus does not require the panel joining assemblies. For example, a structural joining assembly is not required between the first divider panel 410 and the central floor panel 230 and the second floor end panel 250. A structural joining assembly is also not required between the first divider floor panel 410 and the first end panel 310 and the second end panel 320. Rather, the first divider panel 410 is bolted into the central floor panel 230 and the second floor end panel 250. The first divider panel 410 is also bolted into the first end panel 310 and the second end panel 320. The first divider panel 410 is modular in that it is interchangeable with any other divider panel associated with the example modular structure 100.

Referring to FIG. 4B, in which like reference numerals are used to refer to like parts, a detailed divider panel configuration of encircled area 4B taken from FIG. 4A is shown. The third side edge 412*c* of the first divider panel 410 is divided into a first bottom edge 420 and a second bottom edge 430. Dividing line 425 depicts where the first side edge 254*a* of the second end floor panel 250 is joined to the third side edge 234*c* of the center floor panel 230. The first bottom edge 420 is positioned adjacent to the first side edge 254*a* of the second end floor panel 250 while the second bottom edge 430 is positioned adjacent to the third side edge 234*c* of the center floor panel 230. The first bottom edge 420 is bolted into a blind insert (not shown) located in the first side edge 254*a* of the second end floor panel 250 via bolt 450*a* while the second bottom edge 430 is bolted into a blind insert (not shown) located in the third side edge 234*c* of the center floor panel 230 via bolt 450*b*. In an embodiment, a pin rod may be used to align each bolt 450*a* and 450*b* with each corresponding blind insert.

The first divider panel 410 is also divided into a first side edge 460 and a second side edge 470. Dividing line 440 depicts where the second side edge 322*b* (refer to FIG. 3) of the second end panel 320 is joined to the fourth side edge 312*d* of first end panel 310 (see also FIG. 3). The first side edge 460 is positioned adjacent to the second side edge 322*b* (refer to FIG. 3) of the second end panel 320 while the second side edge 470 is positioned adjacent to the fourth side edge 312*d* of the first end panel 310. The first side edge 460 is bolted into a blind insert (not shown) located in the second side edge 322*b* (refer to FIG. 3) of the second end panel 320 via bolt 455*b* while the second side edge 470 is bolted into a blind insert (not shown) located in the fourth side edge 312*d* of the first end panel 310 via bolt 455*a*. The pin rod may be used to align bolt 455*a* or 455*b* into each respective blind insert. For example, a pin rod is inserted into the blind insert corresponding to bolt 455*a*. The insertion of the pin rod into the blind insert aligns bolt 455*b* to its corresponding blind insert so that the bolt 455*b* may bolted into its corresponding blind insert. After bolt 455*b* is bolted into its corresponding blind insert, the pin rod is removed from the blind insert corresponding to bolt 455*a* and bolt 455*a* is then bolted in to its corresponding blind insert.

Figure 5:
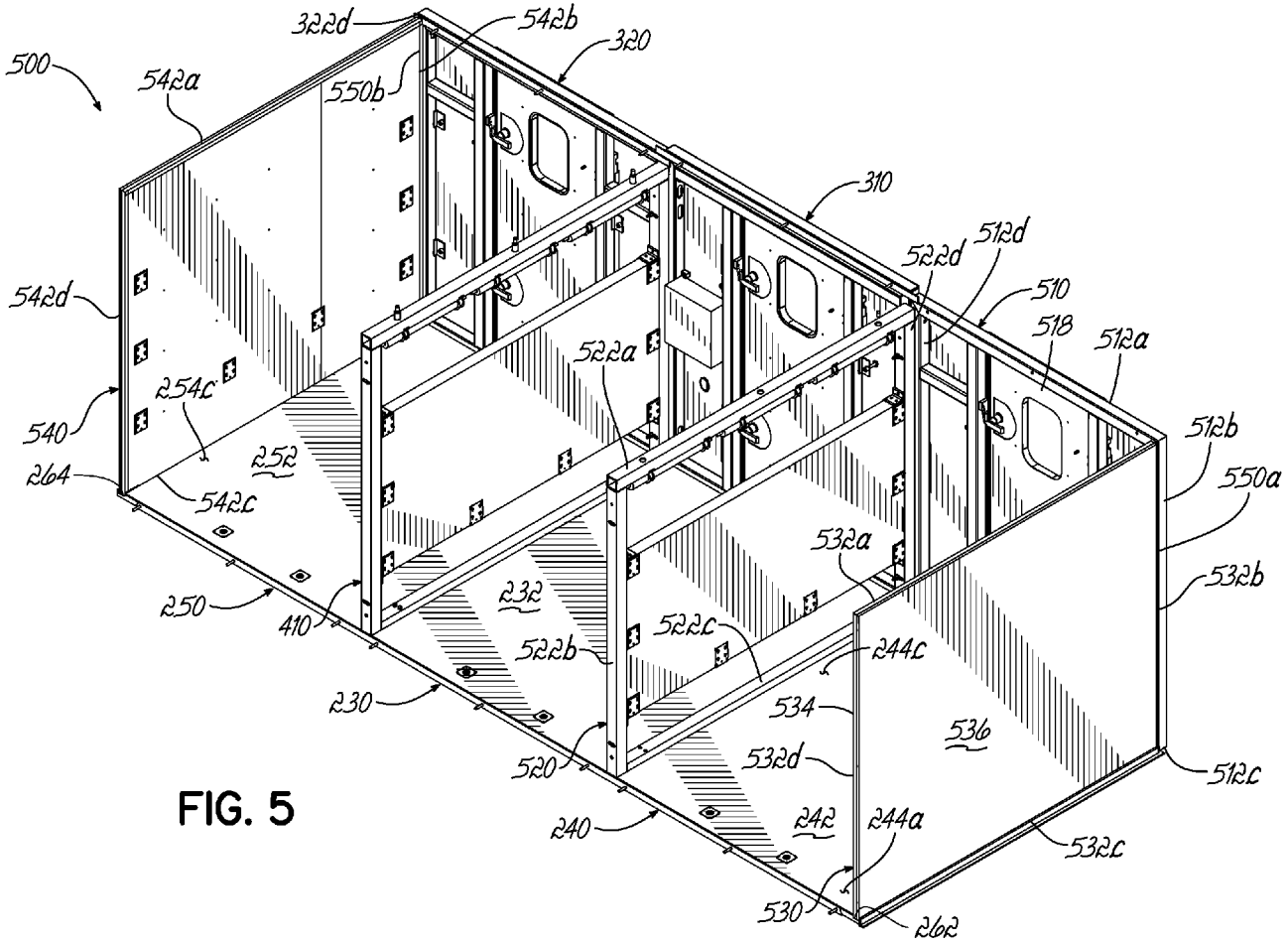
FIG. 5 is a perspective view of an exemplary side panel configuration in accordance with an embodiment of the disclosure.

Referring now to FIG. 5, in which like reference numerals are used to refer to like parts, a side panel configuration 500 is shown. Third end panel 510 may be installed in a similar fashion as first end panel 310 and second end panel 320 as discussed in detail above. The third end panel 510 includes a first side edge 512*a*, a second side edge 512*b*, a third side edge 512*c*, a fourth side edge 512*d*, and a door 518. A second divider panel 520 may be installed in a similar fashion as the first divider panel 410 as discussed in detail above. The second divider panel 520 includes a first side edge 522*a*, a second side edge 522*b*, a third side edge 522*c*, and a fourth side edge 522*d*. A first side panel 530 includes a first side edge 532*a*, a second side edge 532*b*, a third side edge 532*c*, a fourth side edge 532*d*. A second side panel 540 includes a first side edge 542*a*, a second side edge 542*b*, a third side edge 542*c*, a fourth side edge 542*d*.

First side panel 530 is positioned onto first side floor panel 240 and third end panel 510. Second side panel 540 is positioned onto second side floor panel 250 and second end panel 320. The first and second side panels 530 and 540 are to act as the side panels for a bay included in the example modular structure 100. For example in FIG. 1, the first side panel 530 is the side panel 160*a* in bay 110*a*.

The third side edge 532*c* of the first side panel 530 is placed into groove 262 of the first side floor panel 240 joining the third side edge 532*c* of the first side panel 530 to the first side edge 244*a* of the first side floor panel 240 with a tongue and groove joining assembly. The tongue and groove joining assembly also substantially prevents moisture from entering the example modular structure 100 similar to that of the roof joining assembly 140*a* through 140*f* and the panel joining assembly 170*a* through 170*n*. The second side edge 532*b* of the first side panel 530 is joined to the second side edge 512*b* of the third end panel 510 via panel joining assembly 550*a*. The panel joining assembly 550*a* is substantially similar to the panel joining assembly 260*b* discussed in greater detail above.

The third side edge 542*c* of the second side panel 540 is placed into groove 264 of the second side floor panel 250 joining the third side edge 542*c* of the second side panel 540 to the third side edge 254*c* of the second side floor panel 250 with a tongue and groove joining assembly. The second side edge 542*b* of the second side panel 540 is joined to the fourth side edge 322*d* of the second end panel 320 via panel joining assembly 550*b*. The structural joining assembly 550*b* is substantially similar to the structural joining assembly 260*b* discussed in greater detail above. The first side panel 530 and the second side panel 540 are modular in that each are interchangeable with each other and any other side panel associated with the example modular structure 100.

Figure 6A:
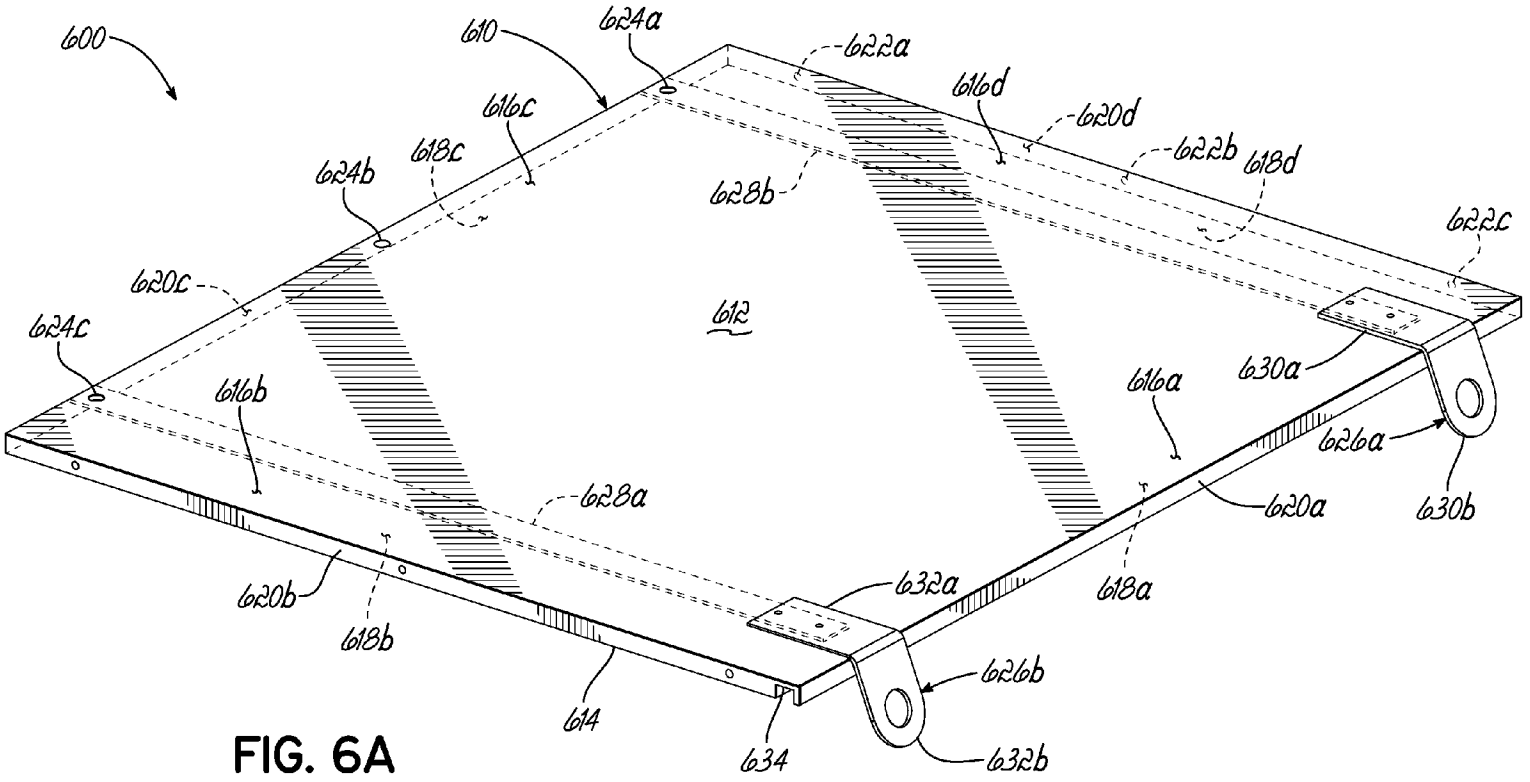
FIG. 6A illustrates an exemplary lower roof panel configuration in accordance with an embodiment of the disclosure.

Referring now to FIG. 6A, in which like reference numerals are used to refer to like parts, a lower roof panel configuration 600 is shown. A first lower roof panel 610 includes a top surface 612 and a bottom surface 614. The first lower roof panel 610 further includes a first top side edge 616*a*, a second top side edge 616*b*, a third top side edge 616*c*, and a fourth top side edge 616*d*. The first lower roof panel 610 further includes a first bottom side edge 618*a*, a second bottom side edge 618*b*, a third bottom side edge 618*c*, and a fourth bottom side edge 618*d*. The first lower roof panel 610 further includes a first side edge 620*a*, a second side edge 620*b*, a third side edge 620*c*, and a fourth side edge 620*d*. The first lower roof panel 610 further includes a first set of bores 622*a*, 622*b*, and 622*c* located on the fourth side edge 618*d*. The first lower roof panel 610 further includes a second set of bores 624*a*, 624*b*, and 624*c* located on the third top side edge 616*c* that go through to the third bottom side edge 618*c*, which will be used to join the first lower roof panel 610 to the upper roof panel 710, described later with reference to FIG. 7B. The first lower roof panel 610 further includes brackets 626*a* and 626*b*. Bracket 626*a* includes first bracket portion 630*a* and second bracket portion 630*b*. Bracket 626*b* includes first bracket portion 632*a* and second bracket portion 632*b*. The first lower roof further includes metal strips 628*a* and 628*b*. The brackets 626*a* and 6262*b* and the metal strips 628*a* and 628*b* will be discussed in detail below with reference to FIG. 8. The first lower roof panel 610 further includes a groove 634.

Figure 6B:
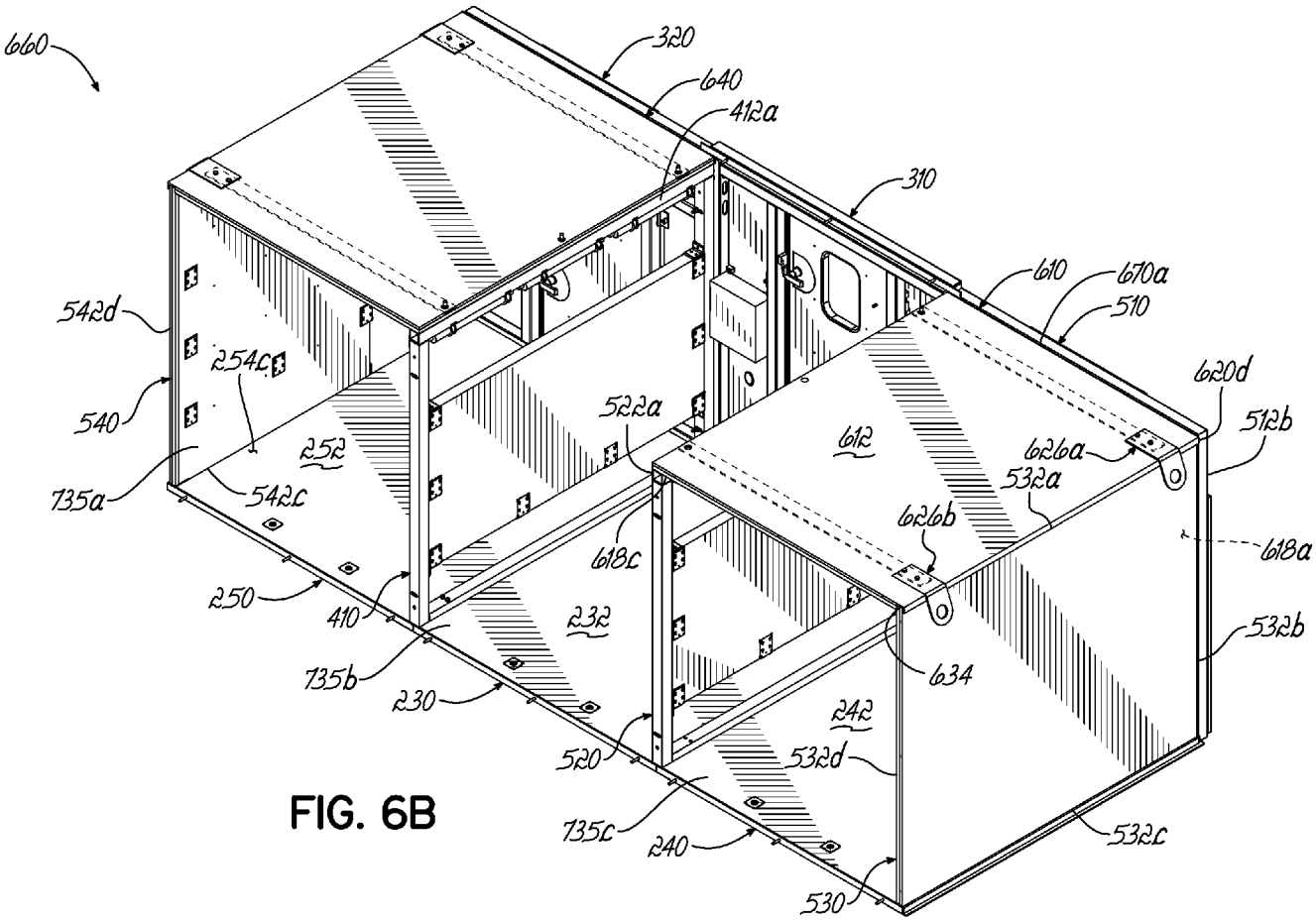
FIG. 6B is a perspective view of an exemplary lower panel roof configuration in accordance with an embodiment of the disclosure.

Referring now to FIG. 6B, in which like reference numerals are used to refer to like parts, a lower panel roof configuration 660 is shown. The first lower roof panel 610 is positioned onto the third side panel 530 and the third end panel 510. The first lower roof panel 610 is to act as the lower roof panel for a bay included in the example modular structure 100. For example in FIG. 1, the first lower roof panel 610 is the lower roof panel 130*a* in bay 110*a*.

The groove 634 of the first lower roof panel 610 is placed onto the first side edge 532*a* of the first side panel 530 joining the bottom side edge 618*a* of the first lower roof panel 610 to the first side edge 532*a* of the first side panel 530 with a tongue and groove joining assembly. The fourth side edge 620*d* of the first roof panel 610 is joined to the first side edge 512*a* of the third end panel 510 via panel joining assembly 670*a*. The panel joining assembly 670*a* is substantially similar to the panel joining assembly 260*b* discussed in greater detail above. The bottom side edge 618*c* of the first roof panel 610 is placed onto the first side edge 522*a* of the second divider panel 520 so that the bottom side edge 618*c* of the first lower roof panel 610 is flush to the first side edge 522*a* of the second divider panel 520. The joining of the bottom side edge 618*c* of the first lower roof panel 610 to the first side edge 522*a* of the second divider panel 520 will be discussed in further detail below with reference to FIG. 6B. The second lower roof panel 640 is assembled in a manner similar to the first lower roof panel 610 discussed in detail above with reference to FIG. 6B.

Figure 7A:
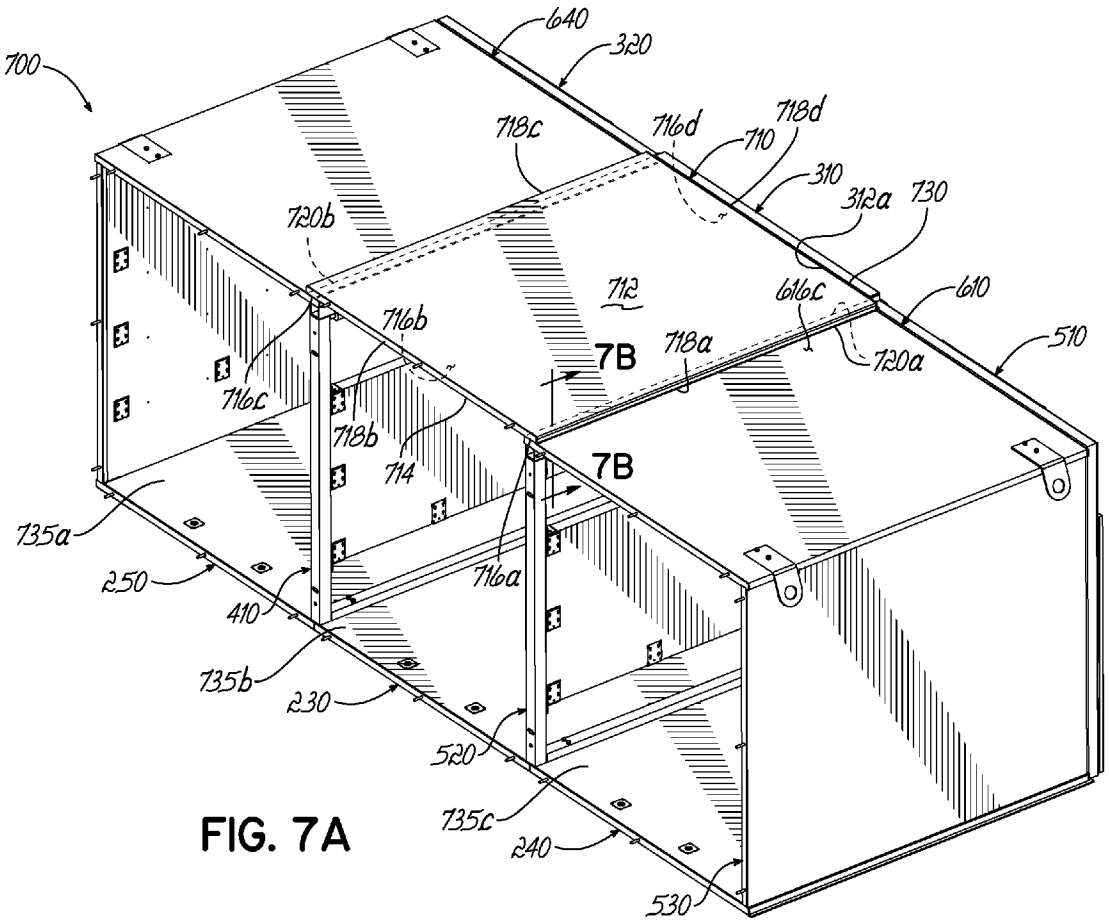
FIG. 7A is a perspective view of an exemplary upper roof panel configuration in accordance with an embodiment of the disclosure.

Referring now to FIG. 7A, in which like reference numerals are used to refer to like parts, an upper roof panel configuration 700 is shown. An upper roof panel 710 includes a top surface 712, a bottom surface 714, a first bottom side edge 716*a*, a second bottom side edge 716*b*, a third bottom side edge 716*c*, a fourth bottom side edge 716*d*, a first side edge 718*a*, a second side edge 718*b*, a third side edge 718*c*, and a fourth side edge 718*c*. The upper roof panel 710 is positioned onto the first lower roof panel 610 and the second lower roof panel 640. The upper roof panel 710 is also joined to the first end panel 310. The upper roof panel 710 acts as the upper roof panel for a bay included in the example modular structure 100. For example in FIG. 1, the upper roof panel 710 is the upper roof panel 125*a* in bay 110*a*.

The first bottom side edge 716*a* of the upper roof panel 710 is positioned onto the third top side edge 616*c* of the first lower roof panel 610. The first bottom side edge 716*a* of the upper roof panel 710 overlaps the third top side edge 616*c* of the first lower roof panel 610 via a roof joining assembly 720*a* that provides a substantially moisture tight seal substantially preventing moisture from entering the example modular structure 100. Further, the overlapping of the first bottom side edge 716*a* of the upper roof panel 710 over the third top side edge 616*c* of the first lower roof panel 610 provides a pathway for water to run off from the upper roof panel 710 down to the first lower roof panel 610 and then off of the example modular structure 100 onto the ground. The water pathway results from the elevated first upper roof panel 710 relative to the first lower roof panel 610 so that the water flows downward from the upper roof panel 710 to the first lower roof panel 610. The roof joining assembly 720*a* is substantially similar to the roof joining assembly depicted by the first structural joining assemblies 140*a* through 140*f* for the example modular structure 100. The roof joining assembly 720*a* will be discussed in further detail below in FIG. 7B. The upper roof panel 710 is positioned onto the second lower roof panel 640 in a similar fashion as the upper roof panel 710 positioned onto the first lower roof panel 610 discussed in detail above.

The third side edge 718*d* of the upper roof panel 710 is joined to the first side edge 312*a* of the first end panel 310 via panel joining assembly 730. The panel joining assembly 730 is substantially similar to the panel joining assembly 260*b* discussed in greater detail above.

Figure 7B:
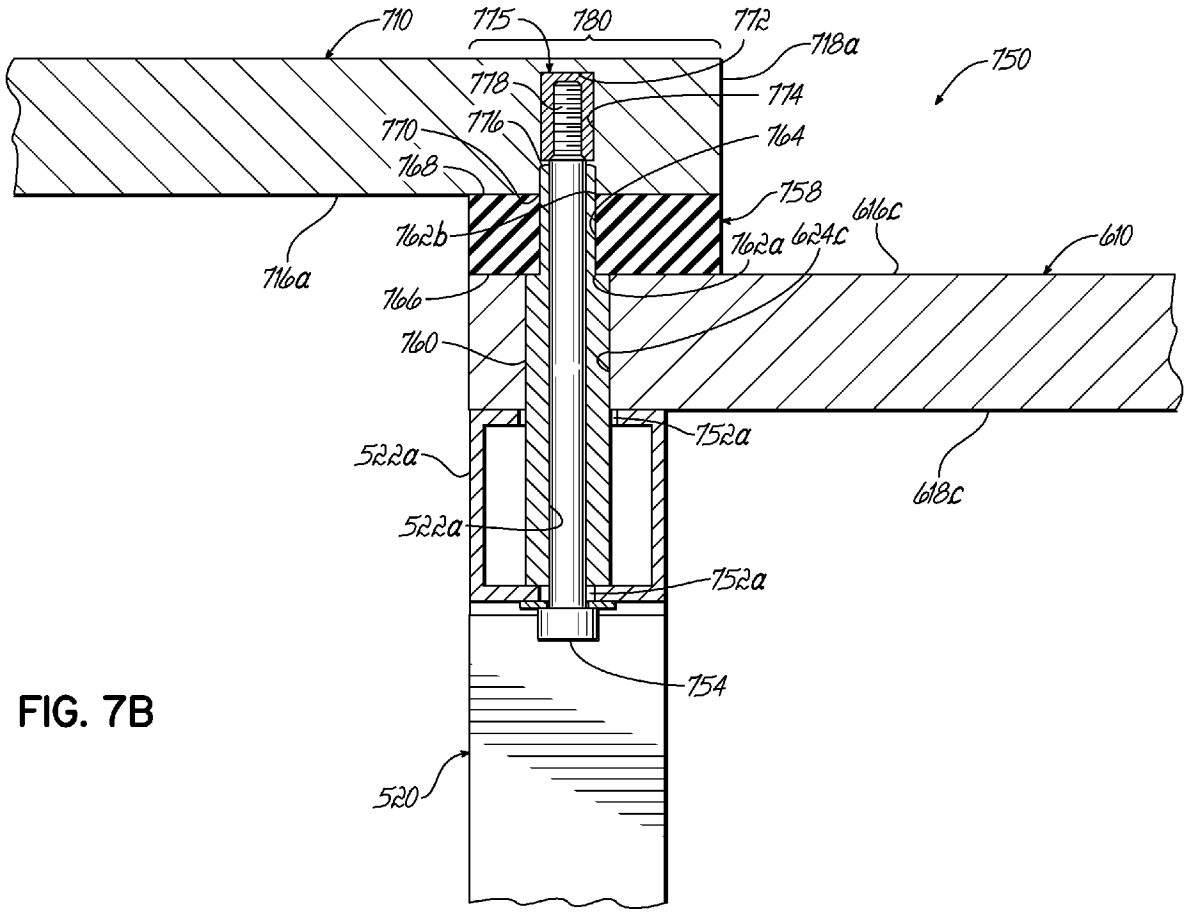
FIG. 7B is a cross sectional view taken along line 7B-7B of FIG. 7A showing a detailed roof joining assembly in accordance with an embodiment of the disclosure.

Referring now to FIG. 7B, in which like reference numerals are used to refer to like a parts, a detailed structural joining assembly 750 is shown. As noted above, the third bottom side edge 618*c* of the first lower roof panel 610 is positioned onto the top side edge 522*a* of the second divider panel 520 so that the bottom side edge 618*c* of the first lower roof panel 610 is flush to the top side edge 522*a* of the second divider panel 520. A metal sleeve 760 is placed through a first opening 752*a* of a bore 756 located in the top side edge 522*a* of the second divider panel 520 and goes through a second opening 752*b* of the bore 756. The metal sleeve 760 continues through the second bore 624*c* located in the third bottom side edge 618*c* of the first lower roof panel 610 and continues through to the third top side edge 616*c* of the first lower roof panel 610. The remaining portion of the metal sleeve 760 is external to the third top side edge 616*c* of the first lower roof panel 610. The metal sleeve 760 aligns second divider panel 520 with the first lower roof panel 610.

A gasket 758 includes a bore 764 with a first opening 762*a* and a second opening 762*b*. The first opening 762*a* of the bore 764 is located on a bottom surface 766 of the gasket 758 while the second opening 762*b* of the bore 764 is located on a top surface 768 of the gasket 758 so that the bore 764 passes from the top surface 768 of the gasket 758 through the gasket 758 to the bottom surface 766 of the gasket 758. The gasket 758 is positioned onto the third top side edge 616*c* of the first lower roof panel 610. The first opening 762*a* of the bore 764 is placed on the metal sleeve 760 so that the metal sleeve 760 goes through the first opening 762*a* of the bore 764 through the bore 764 and out the second opening 762*b* of the bore 764 so that the metal sleeve 760 goes through the gasket 758. The remaining portion of the metal sleeve 760 is external to the top surface 768 of the gasket 758. The metal sleeve 760 aligns the second divider panel 520 with the first lower roof panel 610 with the gasket 758.

The first bottom side edge 716*a* of the upper roof panel 710 is then positioned onto the top surface 768 of the gasket 758. A bore 774 located in the first bottom side edge 716*a* of the upper roof panel 710 includes a first opening 770, an end stop 776. A fastener 775 located at the end stop 776 of the bore 774 includes a threaded portion 778 and a threaded end stop 772. The first opening 770 of the bore 774 is placed on the metal sleeve 760 so that metal sleeve 760 goes through the first opening of the bore 774 and terminates at the end stop 776 of the bore 774. The metal sleeve 760 aligns the second divider panel 520 with the first lower roof panel 610 with the gasket 758 with the upper roof panel 710.

A bolt 754 is then inserted into the metal sleeve 760 so that the bolt passes through the second divider panel 520, the first lower roof panel 610, the gasket 758 and into the bore 774 located in the first bottom side edge 716*a* of the upper roof panel 710 so that the bolt 754 reaches the threaded portion 778 of the fastener 775. The bolt 754 is then tightened so that the bolt 754 engages the threaded portion 778 of the fastener 775 until the bolt 754 reaches the threaded end stop 772 of the fastener 775. The tightening of the bolt 754 until the bolt reaches the threaded end stop 772 of the fastener 775 also tightens the second divider panel 520, the first lower roof panel 610, the gasket 758, and the upper roof panel 710 together forming the roof joining assembly 720*a*. The tightening of the second divider panel 520, the first lower roof panel 610, the gasket 758, and the upper roof panel 710 together via bolt 745 creates a substantially moisture tight seal substantially protecting the inside of the example modular structure 100 from moisture. Further, the description of the metal sleeve 760 discussed above provides a self-alignment mechanism so that the bolt 754 is easily inserted through the divider panel 520, the first lower roof panel 610, the gasket 758, and the upper roof panel 710 so that the bolt 754 may be tightened to form the substantially moisture tight seal. The overlapping of the upper roof panel 710 with the first lower roof panel 610 discussed above may be seen by overlapping portion 780.

Returning briefly to FIG. 7A, after the upper roof panel 710 has been joined to the first lower roof panel 610 via the roof joining assembly 720*a*, the second lower roof panel 640 via the roof joining assembly 720*b*, and the first end panel 310 via the panel joining assembly 730, openings 735*a* through 735*c* remain in the upper roof panel configuration 700. End panels (not shown) may be placed in each opening 735*a* through 735*c* and joined to the existing upper roof panel configuration 700 via panel joining assemblies substantially similar to the panel joining assembly 264*a* discussed in detail above. The joining of the end panels (not shown) to the existing roof panel configuration 700 may complete the existing upper roof panel configuration 700 into a single bay that may stand alone without any further bays added.

Rather than adding additional end panels (not shown), the existing upper roof panel configuration 700 may be extended to include a second bay (not shown). A center floor panel (not shown), first side floor panel (not shown), and a second side floor panel (not shown) may be joined to the existing upper roof panel configuration 700 and the above discussion may be repeated to form a second bay. For example, the existing upper roof panel configuration 700 may represent the first bay 110*a* in the example modular structure 100. A second bay 110*b* may then be assembled to the first bay 110*a* in a similar fashion as the discussion above.

Figure 8:
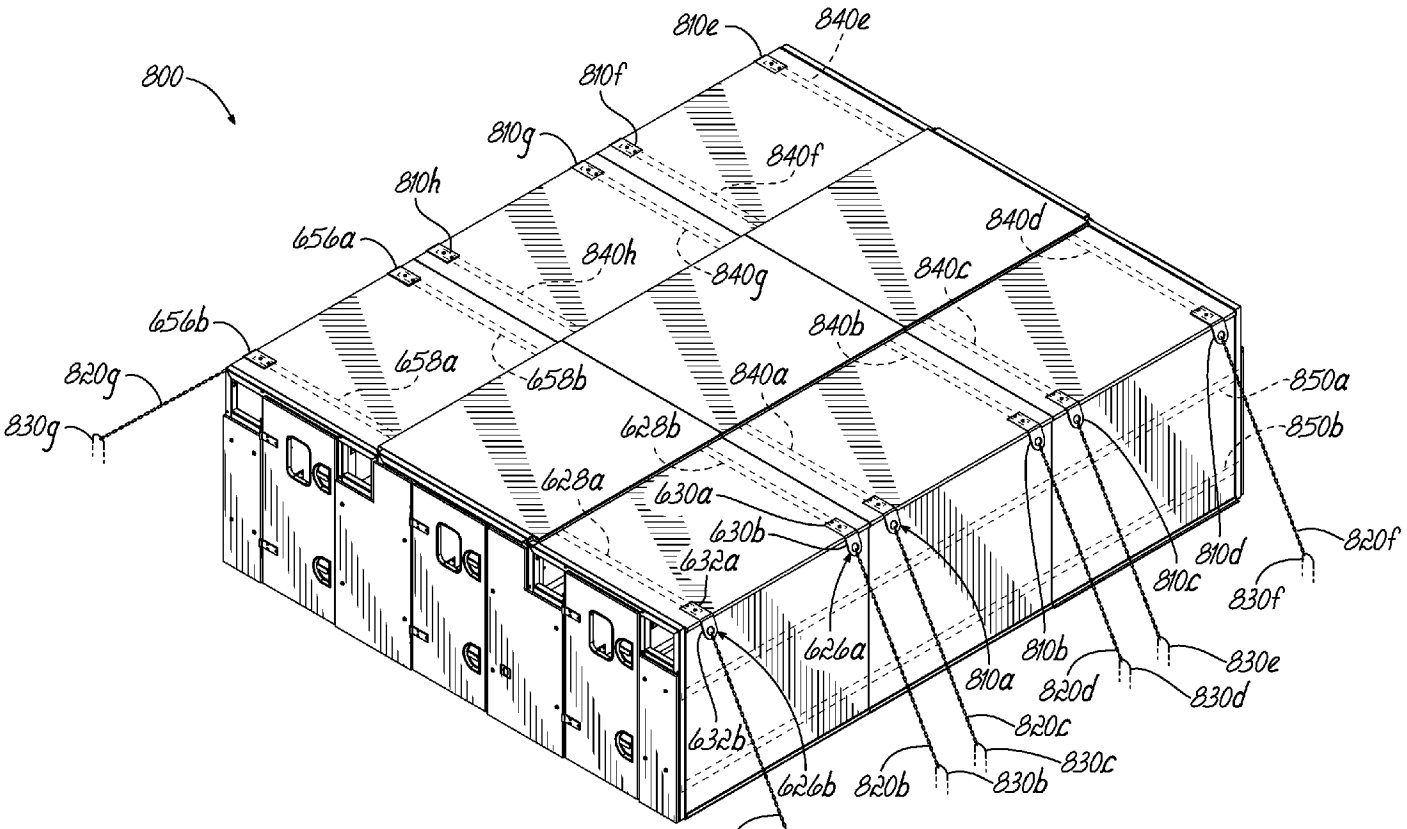
FIG. 8 is a perspective similar to FIG. 1 of an example modular structure in accordance with an embodiment of the disclosure.

Referring now to FIG. 8, in which like reference numerals are used to refer to like parts, an example modular structure 800 is shown. The example modular structure 800 shares many similar features with the example modular structure 100; therefore only differences between the example modular structure 100 and the example modular structure 800 are to be discussed in further detail. The example modular structure 800 includes brackets 626*a*, 626*b*, 656*a*, 656*b*, and 810*a* through 810*h*. The example modular structure 800 also includes chain supports 820*a* through 820*g*; deck anchors 830*a* through 830*g*; metal strips 628*a*, 628*b*, 658*a*, 658*b*, and 840*a* through 840*h*; and ratchet straps 850*e* through 850*g*.

The example modular structure 800 is secured to the deck that the example modular structure 800 is constructed upon, such as a hovercraft deck for example, by chain supports 820*a* through 820*g*. Each chain support 820*a* through 820*g* is connected to a corresponding bracket 626*a*, 626*b*, 656*a*, 656*b*, and 810*a* through 810*h*. Each chain support 820*a* through 820*g* is also connected to each corresponding deck anchor 830*a* through 830*g*. For example, chain 820*a* is hooked into the second bracket portion 632*b* of bracket 626*b* and chain 820*b* is hooked into the second bracket portion 630*b* of bracket 626*a*. Chain 820 is also hooked into the deck anchor 830*a* and chain 820*b* is hooked into deck anchor 830*b*. The hooking of the chain 820*a* from the second bracket portion 632*b* of bracket 626*b* to the deck anchor 830*a* and the hooking of the chain 820*b* from the second bracket portion 630*b* to the deck anchor 830*b* secures the example modular structure 800 to the deck that the example modular structure 800 is constructed upon.

Any force applied to the example modular structure 800 is not sustained by the example modular structure 800. Rather, each received force is transferred in a fashion discussed in detail below so that example modular structure 800 is protected from such received forces. A force transferring configuration is formulated by connecting a metal strip to a corresponding bracket to a corresponding chain to a corresponding deck anchor. For example, metal strip 628*a* is connected to bracket 626*b* which is connected to chain 820*a* which is connected to deck anchor 830*a* forming a force transferring configuration. A force applied to the example modular structure 800 is received by the metal strip 628*a*. Because of the connection of the metal strip 628*a* to the bracket 626*b*, the force is then transferred from the metal strip 628*a* to the bracket 626*b*. Because of the connection of the bracket 626*b* to the chain 820*a*, the force is then transferred from the bracket 626*b* to the chain 820*a*. Because of the connection of the chain 820*a* to the deck anchor 830*a*, the force is then transferred from the chain 820*a* to the deck anchor 830*a*. Thus, the example modular structure 800 is protected from the force.

Referring briefly to FIG. 6A, in an embodiment, the bracket 626*b* is positioned on the first top side edge 616*a* of the first lower roof panel 610. The first bracket portion 632*a* of the bracket 626*b* is bolted to the first top side edge 616*a* of the first lower roof panel 610 while the second bracket portion 632*b* is free from the first lower roof panel 610 to connect to the chain 820*a*. The metal strip 628*a* is positioned internal to the first lower roof panel 610 so that the metal strip 628*a* is positioned in between the top surface 612 of the first lower roof panel 610 and the bottom surface 614 of the first lower roof panel 610. In another embodiment, the first bracket portion 632*a* of the bracket 626*b* is also internal to the first lower roof panel 610 so that the first bracket portion 632*a* of the bracket 626*b* is also positioned in between the top surface 612 of the first lower roof panel 610 and the bottom surface of the first lower roof panel 610. In such an embodiment, the first bracket portion 632*b* is directly connected to the metal strip 628*a*. The bracket 626*b* and the metal strip 628*a* may be arranged in any configuration that sufficiently transfers any force received by the metal strip 628*a* to the bracket 626*b* that will be apparent to those skilled in the relevant art(s) without departing from the scope of the present disclosure.

Referring back to FIG. 8, the example modular structure 800 is clamped with a plurality of ratchet straps that includes ratchet straps 850*a* and 850*b* among other ratchet straps not shown. The plurality of ratchet straps include 850*a* and 850*b* may include strapping mechanisms such as but not limited to a hook assembly, ratchet pullers, turnbuckles, and/or any other strapping mechanism that will clamp the modular structure 800 that will be apparent to those skilled in the relevant art(s) without departing from the scope of the present disclosure. The hook assembly may include a first bracket mounted on a first end of the example modular structure 800. A first end opposite of a hook end included in the hook assembly may be mounted onto the bracket. A second bracket may be mounted on a second end of the example modular structure 800 opposite the first end. The hook end may be mounted to the second bracket. The hook assembly may also include a turnbuckle. The turnbuckle is then tightened compressing each of the modular panels included between the first bracket and the second bracket together.

The ratchet straps 850*a* through 850*h* further compress each of the bays included in the example modular structure so that each of the panel joining assemblies and each of the panel joining assemblies included in the example modular structure 800 are further compressed together. The further compressing of the first structural joining assemblies and the second structural assemblies included in the example modular structure 800 serves to further strengthen the substantially moisture tight seal formed between each adjacent panel included in the example modular structure 800.

Each of the ratchet straps including ratchet straps 850*a* and 850*b* may be placed along a longitudinal axis of the example modular structure 800. Each of the ratchet straps may be placed on a top edge and a bottom edge along each of the modular panels that comprise each of the side walls of the example modular structure 800 and each of the divider panels included in the example modular structure 800. For example, ratchets straps 850*a* and 850*b* are placed on the top edge and the bottom edge of the side wall of the example modular structure 800. Additional ratchet straps (not shown) are also placed on the top edge and the bottom edge of a first set of divider panels (not shown) and a second set of divider panels (not shown) included inside the example modular structure

800. Additional ratchet straps (not shown) are also placed on the top edge and the bottom edge of the side wall of the example modular structure 800 opposite the side wall that ratchet straps 850 and 850 are placed. The plurality of ratchet straps may be placed in any location of the example modular structure 800 that further compresses the panel joining assemblies that will be apparent to those skilled in the relevant art(s) without departing from the scope of the present disclosure.

Figure 9:
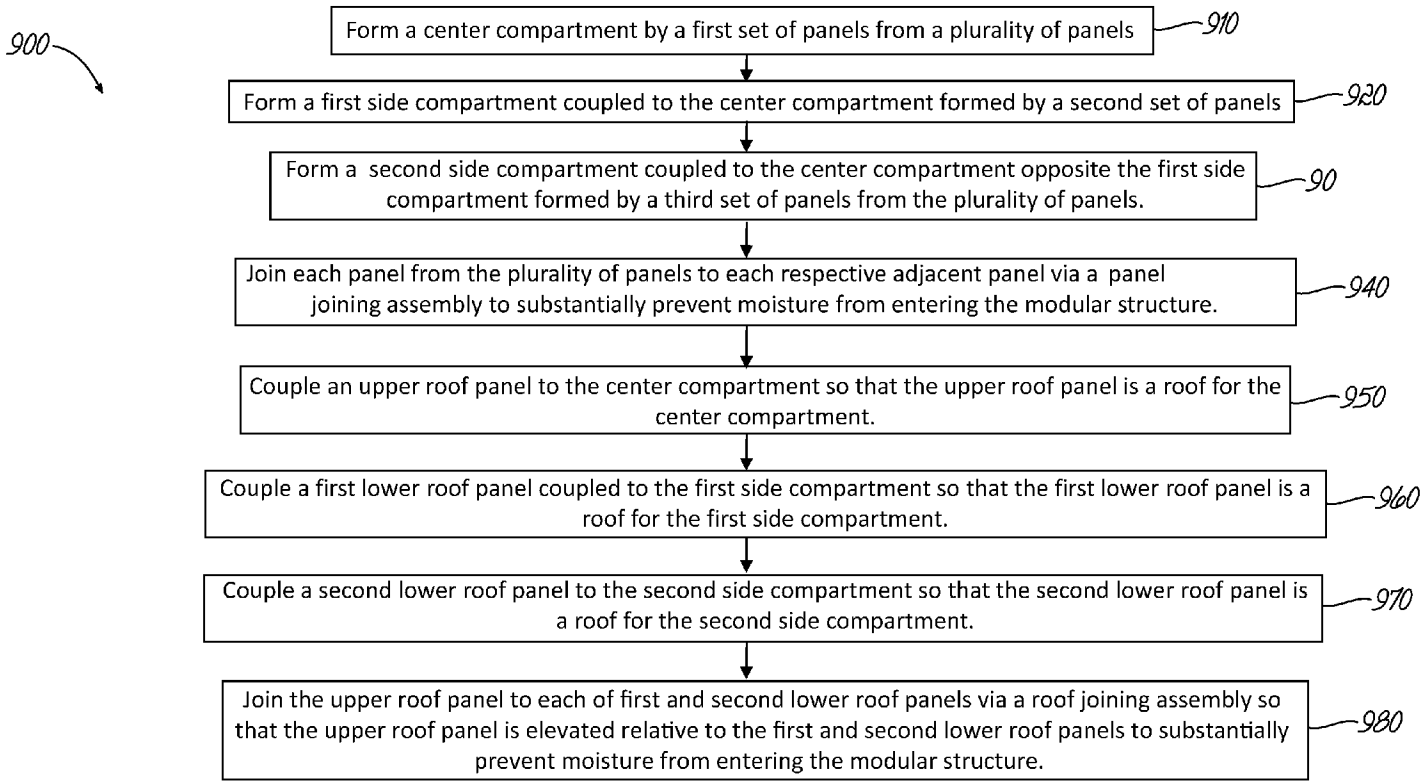
FIG. 9 is a flowchart of exemplary operational steps of an example modular structure according to an embodiment of the disclosure.

FIG. 9 is a flowchart of exemplary operational steps of an example modular structure according to an exemplary embodiment of the present disclosure. The present disclosure is not limited to this operational description. Rather, it will be apparent to persons skilled in the relevant art(s) from the teaching herein that other operational control flows are within the scope of the present disclosure. The following discussion describes the steps in FIG. 9.

At step 910, the operational control flow forms a center compartment by a first set of panels from a plurality of panels.

At step 920, the operational control flow forms a first side compartment coupled to the center compartment formed by a second set of panels from the plurality of panels.

At step 930, the operational control flow forms a second side compartment coupled to the center compartment opposite the first side compartment formed by a third set of panels from the plurality of panels.

At step 940, the operational control flow joins each panel from the plurality of panels to each respective adjacent panel via a panel joining assembly to substantially prevent moisture from entering the modular structure. For example as shown in FIG. 7A, the operational control flow joins the upper roof panel 710 with the first end panel 310 via the panel joining assembly 730. An example of the panel joining assembly 730 is shown in FIG. 2D. The joining of the upper roof panel 710 with the first end panel 310 via the panel joining assembly substantially prevents moisture from entering the modular structure.

At step 950, the operational control flow couples an upper roof panel to the center compartment so that the upper roof panel is a roof for the center compartment.

At step 960, the operational control flow couples a first lower roof panel to the first side compartment so that the first lower roof panel is a roof for the first side compartment.

At step 970, the operational control flow couples a second lower roof panel to the second side compartment so that the second lower roof panel is a roof for the second side compartment.

At step 980, the operational control flow joins the upper roof panel to each of the first and second lower roof panels via a roof joining assembly so that the upper roof panel is elevated relative to the first and second lower roof panels to substantially prevent moisture from entering the modular structure. Specifically, as shown in FIG. 7A, upper roof panel 710, for example, is joined to the first lower roof panel 610 via a roof joining assembly 720*a* so that upper roof panel 710 is elevated relative to the first lower roof panel 610 to substantially prevent moisture from entering the modular structure. An example of the roof joining assembly 720*a* is shown in FIG. 7B.

It is to be appreciated that the Detailed Description section, and not the Abstract section, is intended to be used to interpret the claims. The Abstract section can set forth one or more, but not all exemplary embodiments, of the present disclosure, and thus, are not intended to limit the present disclosure and the appended claims in any way.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope of the general inventive concept.

What is claimed is:

1. A modular structure for housing personnel and/or equipment, comprising:

a center compartment formed by a first set of panels from a plurality of panels;

a first side compartment coupled to the center compartment formed by a second set of panels from the plurality of panels;

a second side compartment coupled to the center compartment opposite of the first side compartment formed by a third set of panels from the plurality of panels, wherein each panel from the plurality of panels is joined to each respective adjacent panel via a panel joining assembly to substantially prevent moisture from entering the modular structure;

an upper roof panel coupled to the center compartment and configured to be a roof for the center compartment;

a first lower roof panel coupled to the first side compartment and configured to be a roof for the first side compartment and joined to the upper roof panel so that the upper roof panel is elevated relative to the first lower roof panel forming a first overlap region;

a second lower roof panel coupled to the second side compartment and configured to be a roof for the second side compartment and joined to the upper roof panel so that the upper roof panel is elevated relative to the second lower roof panel forming a second overlap region;

a first divider panel coupled to the first lower roof panel in the first overlap region and configured to separate the center compartment from the first side compartment;

a second divider panel coupled to the second lower roof panel in the second overlap region and configured to separate the center compartment from the second side compartment and a plurality of roof joining assemblies with each roof joining assembly configured to:

vertically align the first lower roof panel with the upper roof panel and the first divider panel in the first overlap region or the second lower roof panel with the upper roof panel and the second divider panel in the second overlap region via a portion of each roof joining assembly that passes through the first divider panel and the first lower roof panel and terminates in the first overlap region of the upper roof panel or that passes through the second divider panel and the second lower roof panel and terminates in the second overlap region of the upper roof panel, and compress the first divider panel, the first lower roof panel and the upper roof panel with the portion of each respective roof joining assembly that passes through the first divider panel and the first lower roof panel or the second divider panel and the second roof panel so that the portion is concealed by the first divider panel, the first lower roof panel and the upper roof panel in the first overlap region or the second divider panel, the second lower roof panel and the upper roof panel in the second overlap region, thereby substantially preventing moisture from entering the modular structure.

2. The modular structure of claim 1, wherein the roof joining assembly comprises:

a gasket that is positioned in between the upper roof panel and the first lower roof panel in the first overlap region;

a metal sleeve positioned in the first overlap region with a first end that initially passes through the first divider panel, through the first lower roof panel, then passes through the gasket, and then terminates in the upper roof panel in the first overlap region thereby concealing the metal sleeve with the first divider panel, the first lower roof panel, the gasket, and the upper roof panel and configured to vertically align the first divider panel, first lower roof panel, the gasket, and the upper roof panel;

a bolt with an end point of a threaded portion of the bolt and a head of the bolt opposite the end point such that the bolt is positioned in the first overlap region with the threaded portion passing through the metal sleeve from the first divider panel, through the first lower roof panel, then passes through the gasket, and then terminates with the end point in the upper roof panel in the first overlap region thereby concealing the bolt with the first divider panel, the first lower roof panel, the gasket and the upper roof panel and configured to compress the first divider panel, the first lower roof panel, the gasket, and the upper roof panel together when tightened forming a seal to substantially prevent moisture from entering between the upper roof panel and the first lower roof panel.

3. The modular structure of claim 1, wherein the panel joining assembly comprises:

a gasket configured to fit onto a side edge of a first adjacent panel and a side edge of a second adjacent panel; and a plurality of shear pins that protrude through the gasket so that a first end of each shear pin is fitted into the first adjacent panel and a second end of each shear pin is fitted into the second adjacent panel, wherein a seal is formed when the first adjacent panel and the second adjacent panel are compressed together to substantially prevent moisture from entering between the first adjacent panel and the second adjacent panel.

4. The modular structure of claim 1, wherein the first lower roof panel and the second lower roof panel each comprise:

a metal strip positioned on the lower roof panel and configured to receive a force applied to the modular structure;

a bracket positioned on the lower roof panel and connected to the metal strip and configured to receive the force applied to the modular structure from the metal strip;

a chain that connects the bracket to a deck anchor and configured to receive the force applied from the modular structure from the bracket and to transfer the force to a deck anchor so that the force is diverted from the modular structure to protect the modular structure from the force.

5. The modular structure of claim 1, wherein at least one panel from each of the first, second, and third sets of panels includes an end panel having an access door to provide access to an interior of the modular structure.

6. The modular structure of claim 1, wherein the roof joining assembly comprises:

a gasket that is positioned in between the upper roof panel and the second lower roof panel in the second overlap region;

a metal sleeve positioned in the second overlap region with a first end that initially passes through the second divider panel, through the second lower roof panel, then passes through the gasket, and then terminates in the upper roof panel in the second overlap region thereby concealing the metal sleeve with the second lower roof panel, the gasket, and the upper roof panel and configured to vertically align the second divider panel, the second lower roof panel, the gasket, and the upper roof panel;

a bolt with an end point of a threaded portion of the bolt and a head of the bolt opposite the end point such that the bolt is positioned in the second overlap region with the threaded portion passing through the metal sleeve from the second divider panel, through the second lower roof panel, then passes through the gasket, and then terminates with the end point in the upper roof panel in the second overlap region thereby concealing the bolt with the second divider panel, the second lower roof panel, the gasket and the upper roof panel and configured to compress the second divider panel, the second lower roof panel, the gasket, and the upper roof panel together when tightened forming a seal to substantially prevent moisture from entering between the upper roof panel and the second lower roof panel.

7. A modular structure for housing personnel and/or equipment, comprising:

a plurality of bays formed by a plurality of panels so that each panel from the plurality of panels is joined to each respective adjacent panel via a panel joining assembly to substantially prevent moisture from entering the modular structure, wherein each bay includes:

a center compartment formed by a first set of panels from the plurality of panels, a first side compartment coupled to the center compartment formed by a second set of panels from the plurality of panels, a second side compartment coupled to the center compartment opposite of the first side compartment formed by a third set of panels from the plurality of panels, an upper roof panel coupled to the center compartment and configured to be a roof for the center compartment, a first lower roof panel coupled to the first side compartment and configured to be a roof for the first side compartment and joined to the upper roof panel so that the upper roof panel is elevated relative to the first lower roof panel forming a first overlap region, a second lower roof panel coupled to the second side compartment and configured to be a roof for the second side compartment and joined to the upper roof panel so that the upper roof panel is elevated relative to the second lower roof panel forming a second overlap region, a first divider panel coupled to the first lower roof panel in the first overlap region and configured to separate the center compartment from the first side compartment;

a second divider panel coupled to the second lower roof panel in the second overlap region and configured to separate the center compartment from the second side compartment; and a plurality of roof joining assemblies with each roof joining assembly configured to:

vertically align the first lower roof panel with the upper roof panel and the first divider panel in the first overlap region or the second lower roof panel with the upper roof panel and the second divider panel in the second overlap region via a portion of each roof joining assembly that passes through the first divider panel and the first lower roof panel and terminates in the first overlap region of the upper roof panel or that passes through the second divider panel and the second lower roof panel and terminates in the second overlap region of the upper roof panel, and compress the first divider panel, the first lower roof panel and the upper roof panel with the portion of each respective roof joining assembly that passes through the first divider panel and the first lower roof panel or the second divider panel and the second roof panel so that the portion is concealed by the first divider panel, the first lower roof panel and the upper roof panel in the first overlap region or the second divider panel, the second lower roof panel and the upper roof panel in the second overlap region, thereby substantially preventing moisture from entering the modular structure.

8. The modular structure of claim 7, wherein the modular structure is configured to be scaled so that after a first bay from the plurality of bays is assembled, additional bays are assembled and joined to the preceding bay to increase an overall size of the modular structure.

9. The modular structure of claim 8, wherein the roof joining assembly comprises:

a gasket that is positioned between the upper roof panel of each bay and the lower roof panel of each bay in the first overlap region of each bay;

a metal sleeve positioned in the first overlap region with a first end that initially passes through the first divider panel, through the first lower roof panel, then passes through the gasket, and then terminates in the upper roof panel in the first overlap region thereby concealing the metal sleeve with the first divider panel, the first lower roof panel, the gasket, and the upper roof panel and configured to vertically align the first divider panel, the first lower roof panel, the gasket, and the upper roof panel; and a bolt with an end point of a threaded portion of the bolt and a head of the bolt opposite the end point is positioned in the first overlap region with the threaded portion passing through the metal sleeve from the first divider panel, through the first lower roof panel, then passes through the gasket, and then terminates with the end point in the upper roof panel in the first overlap region thereby concealing the bolt with the first lower roof panel, the gasket, and the upper roof panel and configured to compress the first divider panel, the first lower roof panel, the gasket, and the upper roof panel together when tightened forming a seal to substantially prevent moisture from entering between the upper roof panel and the first lower roof panel.

10. The modular structure of claim 7, wherein the panel joining assembly comprises:

a gasket configured to fit onto a side edge of a first adjacent panel and a side edge of a second adjacent panel; and a plurality of shear pins that protrude through the gasket so that a first end of each shear pin is fitted onto the first adjacent panel and a second end of each shear pin is fitted into the second adjacent panel, wherein a seal is formed when the first adjacent panel and the second adjacent panel are compressed together to substantially prevent moisture from entering between the first adjacent panel and the second adjacent panel.

11. The modular structure of claim 7, wherein at least one panel from each of the first, second, and third sets of panels includes an end panel having an access door for at least one of the bays to provide access to an interior of the modular structure.

12. The modular structure of claim 7, wherein the roof joining assembly comprises:

a gasket that is positioned in between the upper roof panel and the second lower roof panel in the second overlap region;

a metal sleeve positioned in the second overlap region with a first end that initially passes through the second divider panel, through the second lower roof panel, then passes through the gasket, and then terminates in the upper roof panel in the second overlap region thereby concealing the metal sleeve with the second lower roof panel, the gasket, and the upper roof panel and configured to vertically align the second divider panel, the second lower roof panel, the gasket, and the upper roof panel;

a bolt with an end point of a threaded portion of the bolt and a head of the bolt opposite the end point such that the bolt is positioned in the second overlap region with the threaded portion passing through the metal sleeve from the second divider panel, through the second lower roof panel, then passes through the gasket, and then terminates with the end point in the upper roof panel in the second overlap region thereby concealing the bolt with the second divider panel, the second lower roof panel, the gasket and the upper roof panel and configured to compress the second divider panel, the second lower roof panel, the gasket, and the upper roof panel together when tightened forming a seal to substantially prevent moisture from entering between the upper roof panel and the second lower roof panel.

13. A method for forming a modular structure for housing personnel and/or equipment, comprising:

forming a center compartment by a first set of panels from a plurality of panels;

forming a first side compartment coupled to the center compartment formed by a second set of panels from the plurality of panels;

forming a second side compartment coupled to the center compartment opposite of the first side compartment formed by a third set of panels from the plurality of panels, joining each panel from the plurality of panels to each respective adjacent panel via a panel joining assembly to substantially prevent moisture from entering the modular structure;

coupling an upper roof panel to the center compartment so that the upper roof panel is a roof for the center compartment;

coupling a first lower roof panel to the first side compartment so that the first lower roof panel is a roof for the first side compartment and joined to the upper roof panel so that the upper roof panel is elevated relative to the first lower roof panel forming a first overlap region;

coupling a second lower roof panel to the second side compartment so that the second lower roof panel is a roof for the second side compartment and joined to the upper roof panel so that the upper roof panel is elevated relative to the second lower roof panel forming a second overlap region;

coupling a first divider panel to the first lower roof panel in the first overlap region and joined to the first lower roof panel to separate the center compartment from the first side compartment;

coupling a second divider panel to the second lower roof panel in the second overlap region and joined to the second lower roof panel to separate the center compartment from the second side compartment;

vertically aligning the first lower roof panel with the upper roof panel and the first divider panel in the first overlap region via a first plurality of roof joining assemblies that pass through the first divider panel and the first lower roof panel and terminate in the first overlap region of the upper roof panel;

vertically aligning the second lower roof panel with the upper roof panel and the second divider panel in the second overlap region via a second plurality of roof joining assemblies that pass through the second divider panel and the second lower roof panel and terminate in the second overlap region of the upper roof panel;

compressing the first divider panel, the first lower roof panel and the upper roof panel with the portion of each of the first plurality of roof joining assemblies that pass through the first divider panel and the first lower roof panel so that each portion is concealed by the first divider panel, the first lower roof panel and the upper roof panel in the first overlap region, thereby substantially preventing moisture from entering the modular structure; and compressing the second divider panel, the second lower roof panel and the upper roof panel with the portion of each of the second plurality of roof joining assemblies that pass through the second divider panel and the second lower roof panel so that each portion is concealed by the second divider panel, the second lower roof panel and the upper roof panel in the second overlap region, thereby substantially preventing moisture from entering the modular structure.

14. The method of claim 13, wherein the joining of the upper roof panel to the first lower roof panel comprises:

positioning a gasket in between the upper roof panel and the first lower roof panel in the first overlap region;

positioning a metal sleeve in the first overlap region with a first end that initially passes through the first divider panel, through the first lower roof panel, then passes through the gasket, and then terminates in the upper roof panel in the first overlap region thereby concealing the metal sleeve with the first divider panel, the first lower roof panel, the gasket, and the upper roof panel and vertically aligning the first divider panel, first lower roof panel, the gasket, and the upper roof panel;

positioning a bolt with an end point of a threaded portion of the bolt and a head of the bolt opposite the end point in the first overlap region with the threaded portion passing through the metal sleeve from the first divider panel, through the first lower roof panel, then passes through the gasket, and then terminates with the end point in the upper roof panel in the first overlap region thereby concealing the bolt with the first divider panel, the first lower roof panel, the gasket, and the upper roof panel;

tightening the bolt to compress the first divider panel, the first lower roof panel, the gasket, and the upper roof panel together;

forming a seal to substantially prevent moisture from entering between the upper roof panel and the first lower roof panel when compressed together by the bolt.

15. The method of claim 13, wherein the joining each panel from the plurality of panels to each respective adjacent panel via the panel joining assembly comprises:

fitting a gasket onto a side edge of a first adjacent panel and a side edge of a second adjacent panel;

fitting a plurality of shear pins that protrude through the gasket into the side edge of the first adjacent panel and the second adjacent panel so that a first end of each shear pin is fitted into the first adjacent panel and the second end of each shear pin is fitted into the second adjacent panel;

compressing together the first adjacent panel and the second adjacent panel; and forming a seal to substantially prevent moisture from entering between the first adjacent panel and the second adjacent panel when compressed together.

16. The method of claim 13, further comprising:

placing a plurality of ratchet straps around the modular structure; and compressing each of the panel joining assemblies by clamping each ratchet strap to further enhance the joining of each of the adjacent panels to form seals that substantially prevent moisture from entering the modular structure.

17. The method of claim 13, further comprising:

connecting a chain from a bracket included on each of the first and second lower roof panels to a deck anchor to receive a force applied to the modular structure that is transferred from a metal strip connected to the bracket and to transfer the force from the bracket to the deck anchor so that the force is diverted from the modular structure to protect the modular structure from the force.

18. The method of claim 13, wherein at least one panel from each of the first, second, and third sets of panels includes an end panel having an access door to provide access to an interior of the modular structure.

19. The method of claim 13, wherein the joining of the upper roof panel to the second lower roof panel comprises:

positioning a gasket in between the upper roof panel and the second lower roof panel in the second overlap region;

positioning a metal sleeve in the second overlap region with a first end that initially passes through the second divider panel, through the second lower roof panel, then passes through the gasket, and then terminates in the upper roof panel in the second overlap region thereby concealing the metal sleeve with the second divider panel, the second lower roof panel, the gasket, and the upper roof panel and vertically aligning the second divider panel, second lower roof panel, the gasket, and the upper roof panel;

positioning a bolt with an end point of a threaded portion of the bolt and a head of the bolt opposite the end point in the second overlap region with the threaded portion passing through the metal sleeve from the second divider panel, through the second lower roof panel, then passes through the gasket, and then terminates with the end point in the upper roof panel in the second overlap region thereby concealing the bolt with the second divider panel, the second lower roof panel, the gasket, and the upper roof panel;

tightening the bolt to compress the second divider panel, the second lower roof panel, the gasket, and the upper roof panel together;

forming a seal to substantially prevent moisture from entering between the upper roof panel and the second lower roof panel when compressed together by the bolt.

* * * * *